US009698509B2

(12) United States Patent
Ashibu

(10) Patent No.: US 9,698,509 B2
(45) Date of Patent: Jul. 4, 2017

(54) CONNECTOR

(71) Applicant: JAPAN AVIATION ELECTRONICS INDUSTRY, LIMITED, Shibuyaku, Tokyo (JP)

(72) Inventor: Kenta Ashibu, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 24 days.

(21) Appl. No.: 14/597,919

(22) Filed: Jan. 15, 2015

(65) Prior Publication Data

US 2015/0244092 A1 Aug. 27, 2015

(30) Foreign Application Priority Data

Feb. 21, 2014 (JP) ..... 2014-031726

(51) Int. Cl.

| | |
|---|---|
| ***H01R 12/88*** | (2011.01) |
| ***H01R 12/79*** | (2011.01) |
| ***H01R 12/87*** | (2011.01) |
| ***H01R 12/77*** | (2011.01) |
| *H01R 13/62* | (2006.01) |

(52) U.S. Cl.
CPC ..... *H01R 12/774* (2013.01); *H01R 12/88* (2013.01); *H01R 12/79* (2013.01)

(58) Field of Classification Search
CPC ..... H01R 12/774; H01R 12/79; H01R 12/87; H01R 12/88; H01R 13/62; H01R 439/372; H01R 439/345
See application file for complete search history.

(56) References Cited

U.S. PATENT DOCUMENTS

| | | | | |
|---|---|---|---|---|
| 7,455,547 | B2 * | 11/2008 | Hemmi | H01R 12/79 439/260 |
| 8,323,044 | B2 * | 12/2012 | Tsunemura | H01R 12/79 439/267 |
| 9,070,993 | B2 * | 6/2015 | Honda | H01R 12/88 |
| 9,166,332 | B2 * | 10/2015 | Matoba | H01R 13/6275 |
| 2006/0089036 | A1 * | 4/2006 | Takai | H01R 12/771 439/260 |

(Continued)

FOREIGN PATENT DOCUMENTS

JP 2013196784 A 9/2013

*Primary Examiner* — James Harvey
*Assistant Examiner* — Matthew T Dzierzynski
(74) *Attorney, Agent, or Firm* — Holtz, Holtz & Volek PC

(57) ABSTRACT

A connector which makes it possible to prevent an object to be connected from being easily removed therefrom. When a flexible printed wiring board is inserted into an insertion portion from an insertion slot of a housing, abutment portions of an operation member are pushed and rotated by the flexible printed wiring board, and are moved in a direction away from the insertion portion, and an operation portion of the operation member is rotated, whereby movable arm portions of first contacts and second contacts are moved in the direction away from the insertion portion. When the flexible printed wiring board is inserted to a predetermined position in the insertion portion, locking portions of the abutment portions are inserted in receiving portions of the housing through receiving portions of the flexible printed wiring board, and the movable arm portions are moved in a direction approaching to the insertion portion.

14 Claims, 31 Drawing Sheets

(56) References Cited

U.S. PATENT DOCUMENTS

| | | | | |
|---|---|---|---|---|
| 2006/0189190 | A1* | 8/2006 | Kato | H01R 12/771<br>439/261 |
| 2007/0117451 | A1* | 5/2007 | Yokoyama | H01R 12/88<br>439/495 |
| 2010/0068919 | A1* | 3/2010 | Taketomi | H01R 12/88<br>439/499 |
| 2012/0231646 | A1* | 9/2012 | Nakano | H01R 12/79<br>439/267 |
| 2012/0268137 | A1* | 10/2012 | Takamori | H01R 12/62<br>324/538 |
| 2013/0280947 | A1* | 10/2013 | Matoba | H01R 13/62<br>439/372 |

* cited by examiner

CONNECTOR

BACKGROUND OF THE INVENTION

Field of the Invention

This invention relates to a connector.

Description of the Related Art

Conventionally, as shown in FIGS. 15 and 16, there has been proposed a connector including a housing 901 on which contact members 902, engaging members 903, and an operation member 904 are mounted (see Japanese Laid-Open Patent Publication (Kokai) No. 2013-196784).

The housing 901 has the engaging members 903, two in number, and the contact members 902, ten in number, mounted thereon. The ten contact members 902 are arranged between the two engaging members 903. The housing 901 has an insertion recess 906 in which a board 917 is inserted.

The operation member 904 has a substantially long plate-like shape. The operation member 904 has opposite ends each formed with an abutment receiving portion 939. The abutment receiving portion 939 has an inclined portion 939A. The operation member 904 is formed with grooves 940 at substantially equally-spaced intervals, and each groove 940 is formed with a shaft portion 943, whereby the operation member 904 is pivotally supported by the contact members 902.

When the board 917 is inserted into the insertion recess 906 of the housing 901, first, a front end of the board 917 is brought into abutment with the inclined portions 939A of the abutment receiving portions 939.

When the board 917 is pushed into the insertion recess 906, the abutment receiving portions 939 are pushed by the front end of the board 917, whereby the operation member 904 is rotated about the shaft portions 943.

As the board 917 is pushed deep into the insertion recess 906, the operation member 904 is rotated toward an elected position.

When the board 917 is further pushed into the insertion recess 906, the operation member 904 is rotated from the elected position to a horizontal position by the returning force of the contact members 902. At this time, the abutment receiving portions 939 of the operation member 904 are latched in latching cutouts 918 of the board 917 (see FIG. 17), respectively, whereby the board 917 is prevented from falling out of the housing 901.

As described above, in the conventional connector, since the abutment receiving portions 939 of the operation member 904 are latched in the latching cutouts 918 of the board 917, the board 917 is difficult to fall out of the housing 901.

However, as shown in FIG. 17, a latched portion of each of the abutment receiving portions 939 in an associated one of the latching cutouts 918 of the board 917 is not large.

Therefore, if a large force is generated in a direction of pulling out the board 917 due to some cause, there is a possibility that the board 917 is easily removed from the housing 901.

SUMMARY OF THE INVENTION

The present invention has been made in view of these circumstances, and an object thereof is to provide an connector which makes it possible to prevent an object to be connected from being easily removed therefrom.

To attain the above object, the present invention provides a connector comprising a housing having an insertion portion in which an object to be connected is inserted, a plurality of contacts that are held by the housing, and each include a movable arm portion which extends from an inner end of the insertion portion toward an insertion slot of the insertion portion and is elastically deformable, and an operation member that is rotatably supported by the housing, and includes an operation portion which operates the movable arm portion, and an abutment portion which is linked to the operation portion and is pushed and rotated by the object to be connected which is inserted into the insertion portion to thereby transmit a rotational force to the operation portion, wherein when the object to be connected is inserted into the insertion portion, the abutment portion is pushed by the object to be connected to thereby rotate in a direction away from the insertion portion, and the operation portion is rotated to thereby move the movable arm portion in a direction away from the insertion portion, and when the object to be connected is inserted to a predetermined position in the insertion portion, the movable arm portion is moved in a direction approaching to the insertion portion, wherein the abutment portion includes a locking portion which is inserted in an object-to-be-connected-side receiving portion formed in the object to be connected when the object to be connected is inserted to the predetermined position in the insertion portion, to thereby prevent the object to be connected from moving in a direction opposite to a direction of inserting the object to be connected, and wherein the housing includes a housing-side receiving portion which receives the locking portion when the object to be connected is inserted to the predetermined position in the insertion portion, to thereby prevent the abutment portion from moving in the opposite direction.

Preferably, the abutment portion is at a location closer to the inner end of the insertion portion than the operation portion is.

Preferably, the operation member includes an unlocking operation portion which applies a rotational force to the abutment portion to thereby cause the locking portion received in the housing-side receiving portion to be moved out of the insertion portion.

Preferably, the plurality of contacts each include a contact portion which is formed on the movable arm portion, protrudes into the insertion portion, and is brought into contact with the object to be connected.

More preferably, the plurality of contacts each include a fixed arm portion which extends from the inner end of the insertion portion toward the insertion slot, a linking portion which links the fixed arm portion and the movable arm portion at the inner end of the insertion portion, and a connection portion which is formed on the fixed arm portion and is connected to the other object to be connected.

Further preferably, the plurality of contacts each include a spring portion which is formed on the fixed arm portion and extends from toward the insertion slot toward the inner end of the insertion portion, and a fixed arm portion-side contact portion which is formed on the spring portion in a manner opposed to the contact portion and protrudes into the insertion portion, and at least one of the contact portion and the fixed arm portion-side contact portion is brought into contact with the object to be connected.

More preferably, the plurality of contacts are formed by first contacts and second contacts which are different in type from the first contacts, and the first contacts and the second contacts are alternately arranged at predetermined intervals in a longitudinal direction of the housing.

Further preferably, the positions of the contact portion of each first contact and the contact portion of each second contact are displaced in the direction of inserting the object to be connected, the first contacts being mounted from a side of the insertion slot of the housing, the second contacts being mounted from a rear side of the housing.

Further preferably, the connection portion of the first contact is at a location toward the insertion slot, and the connection portion of the second contact is at a location toward the rear surface of the housing.

Further preferably, the operation portion includes a body having a cylindrical shape, first recesses which are formed in the body and receive front ends of the first contacts, respectively, and second recesses which are formed in the body and receive front ends of the second contacts, respectively, and the first recesses and the second recesses are alternately arranged at predetermined intervals in a longitudinal direction of the body, the positions of each first recess and each second recess being displaced by 90 degrees in a circumferential direction of the body.

Preferably, the insertion slot of the housing has a periphery formed with a guiding portion for guiding the object to be connected into the insertion portion.

According to the present invention, it is possible to make the object to be connected difficult to be removed from the connector.

The above and other objects, features and advantages of the present invention will become more apparent from the following detailed description taken in conjunction with the accompanying drawings.

DETAILED DESCRIPTION OF THE PREFERRED EMBODIMENT

The present invention will now be described in detail with reference to the drawings showing preferred embodiments thereof.

Figure 1:
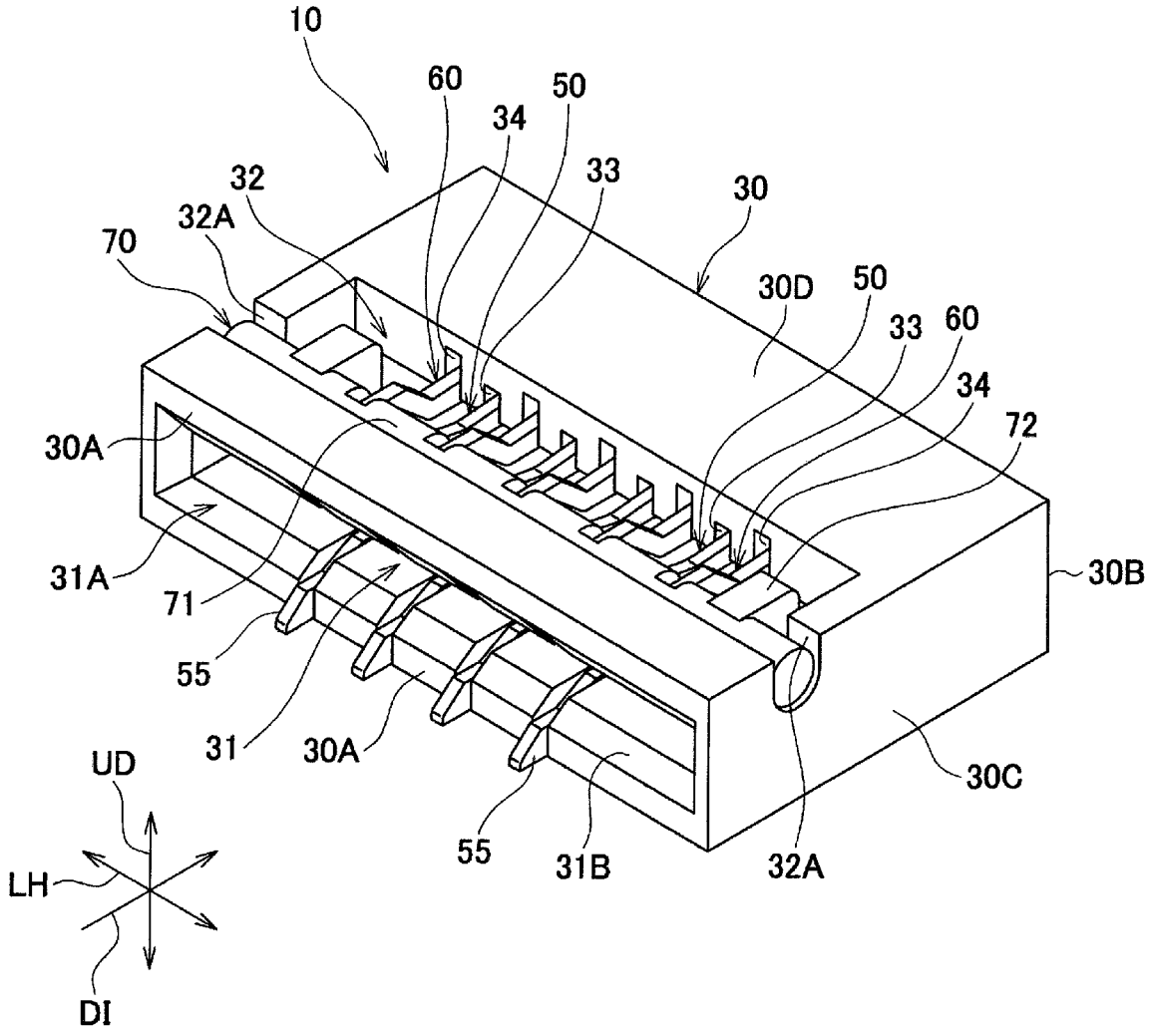
FIG. 1 is a perspective view of a connector according to a first embodiment of the present invention.

As shown in FIG. 1, a connector 10 according to a first embodiment of the present invention is comprised of a housing 30, first contacts 50, second contacts 60, and an operation member 70.

Figure 6:
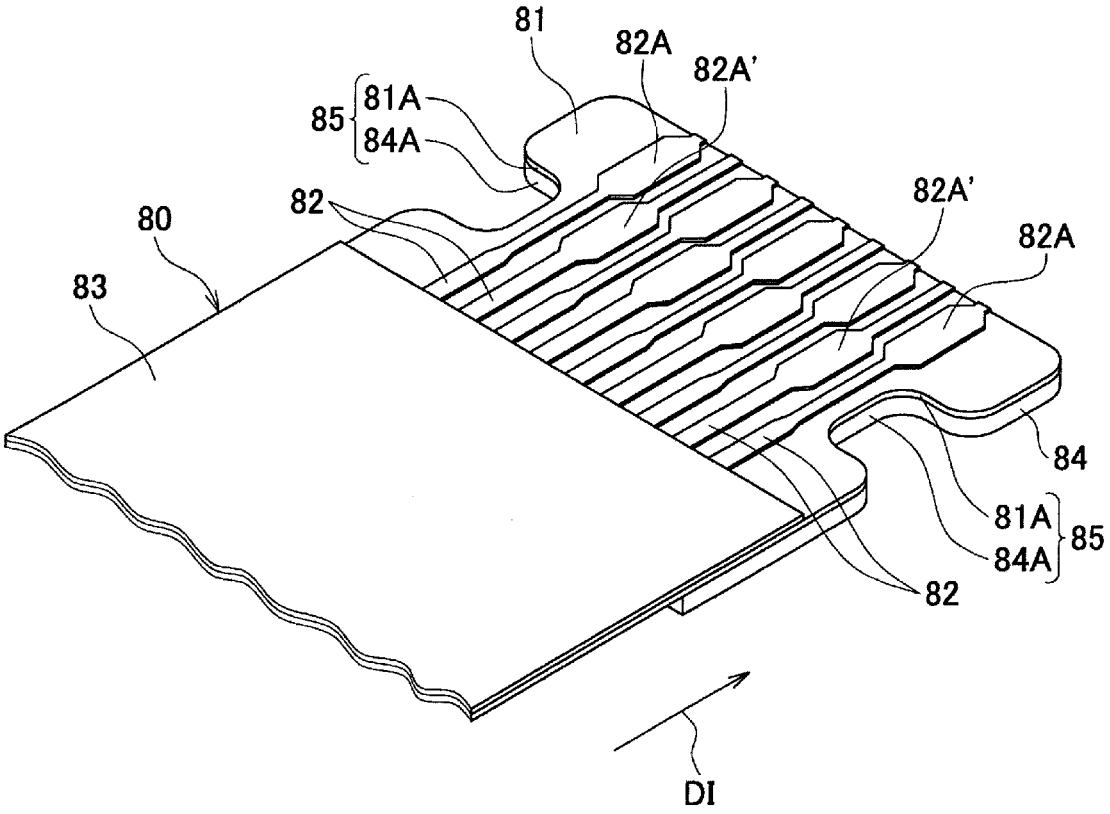
FIG. 6 is a perspective view of a flexible printed wiring board to be connected to the connector shown in FIG. 1.

The connector 10 is mounted on a printed circuit board (another object to be connected), not shown, and receives a flexible printed wiring board (an object to be connected) 80 shown in FIG. 6 to thereby electrically connect the printed circuit board and the flexible printed wiring board 80.

As shown in FIG. 6, the flexible printed wiring board 80 includes a belt-like base film 81, a plurality of conductive paths 82 which are formed on one surface of the base film 81, a cover film 83 which is affixed to the one surface of the base film 81 to cover the conductive paths 82, and a reinforcing plate 84 which is affixed to one end of the other surface of the base film 81. The base film 81 has one end having cutouts 81A formed at opposite sides thereof. The plurality of conductive paths 82 each extend in a longitudinal direction of the base film 81. Odd-numbered conductive paths 82, counted from one at a left end (left end as viewed in FIG. 6) of the flexible printed wiring board 80, each have one end formed with a terminal portion 82A. The terminal portion 82A is larger in width than the other portion of the conductive path 82. Even-numbered conductive paths 82, counted from the one at the left end of the flexible printed wiring board 80, each have one end formed with a terminal portion 82A'. The terminal portion 82A' is larger in width than other portion of the conductive path 82. The terminal portion 82A is displaced from the terminal portion 82A' in a direction DI of inserting the flexible printed wiring board 80. One end portion of the cover film 83 is removed, whereby the terminal portions 82A and 82A' of the conductive paths 82 are exposed. The reinforcing plate 84 is formed with cutouts 84A. The cutouts 84A have the same shapes as respective associated ones of the cutouts 81A of the base film 81 and are opposed thereto in a direction of a thickness of the reinforcing plate 84. Each cutout 81A of the base film 81 and each cutout 84A of the reinforcing plate 84 form a receiving portion (object-to-be-connected-side receiving portion) 85.

Figure 7A:
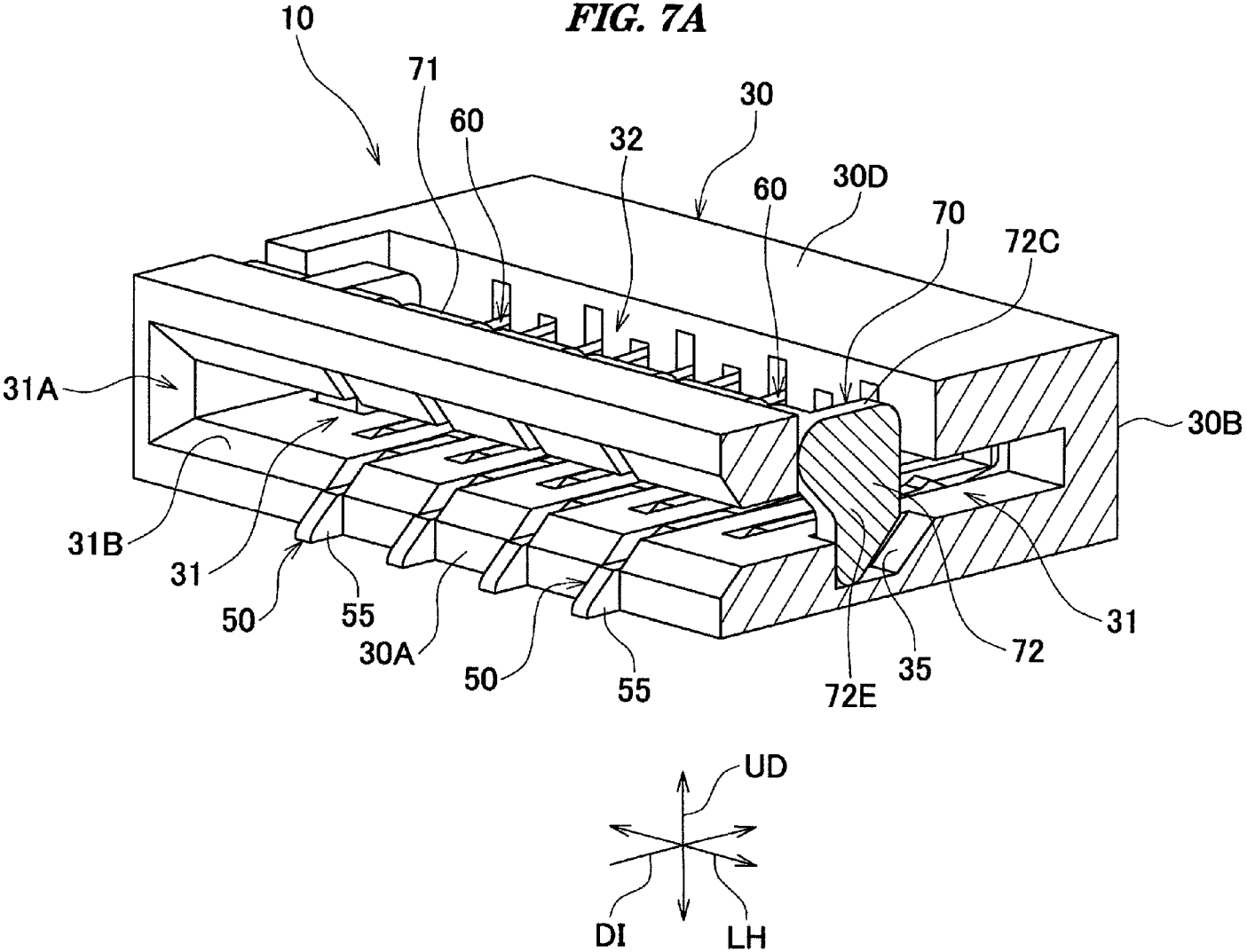
FIG. 7A is a partially cut-away perspective view of the connector before having the flexible printed wiring board connected thereto, with a section of an abutment portion.

As shown in FIGS. 1 and 7A, the housing 30 is casing-shaped, and includes an insertion portion 31, an accommodation portion 32, first contact-accommodating chambers 33, second contact-accommodating chambers 34, and receiving portions (housing-side receiving portions) 35. The housing 30 of the connector 10 is made of insulating resin.

The insertion portion 31 is a space extending from a front surface 30A toward a rear surface 30B of the housing 30. The insertion portion 31 has an insertion slot 31A formed in the front surface 30A of the housing 30. The flexible printed wiring board 80 is inserted into the insertion portion 31 from the insertion slot 31A. The insertion slot 31A of the housing 30 has a periphery formed with guiding portions 31B for guiding the flexible printed wiring board 80 into the insertion portion 31.

The accommodation portion 32 is formed in a top surface 30D of the housing 30 to accommodate the operation member 70 in a rotatable manner. The accommodation portion 32 communicates with the insertion portion 31. The accommodation portion 32 reaches opposite side portions 30C of the housing 30, where bearing portions 32A are formed.

The first contact-accommodating chambers 33 and the second contact-accommodating chambers 34 are alternately arranged at predetermined intervals in a longitudinal direction LH of the housing 30. The first contact-accommodating chambers 33 and the second contact-accommodating chambers 34 each extend in the insertion direction DI.

Figure 7B:
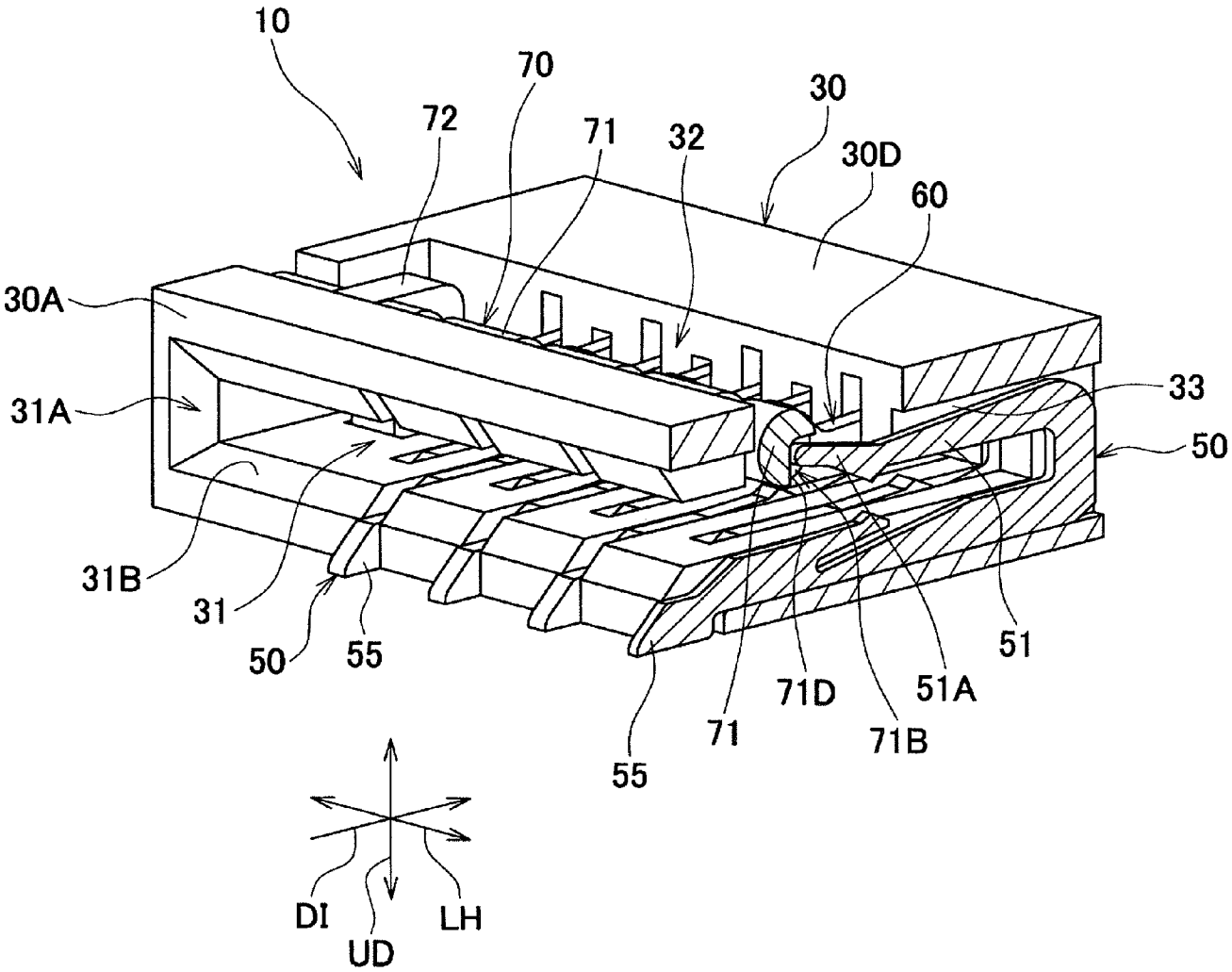
FIG. 7B is a partially cut-away perspective view of the connector before having the flexible printed wiring board connected thereto, with a section of the first contact.

The first contact-accommodating chambers 33 accommodate and hold the first contacts 50, respectively. The first contact-accommodating chambers 33 communicate with the insertion portion 31 and the accommodation portion 32 (see FIGS. 7B and 8B). A front end of each first contact-accommodating chamber 33 reaches the front surface 30A of the housing 30, and communicates with the outside. A rear end of each first contact-accommodating chamber 33 reaches the rear surface 30B of the housing 30, and communicates with the outside.

The second contact-accommodating chambers 34 accommodate and hold the second contacts 60, respectively. The second contact-accommodating chambers 34 communicate with the insertion portion 31 and the accommodation portion 32. A rear end of each second contact-accommodating chamber 34 reaches the rear surface 30B of the housing 30, and communicates with the outside (see FIGS. 7C and 8C).

Figure 12A:
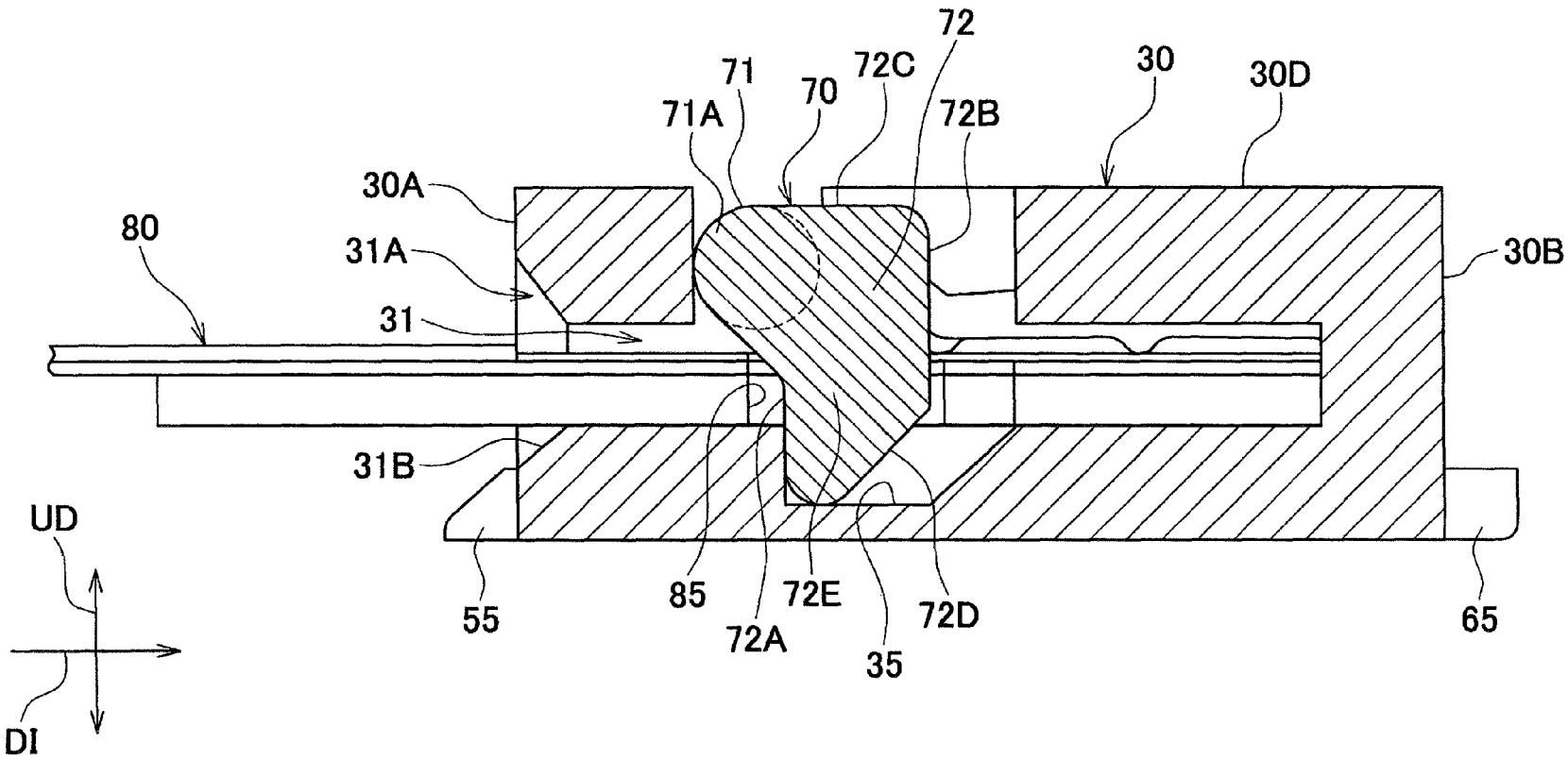
FIG. 12A is a longitudinal cross-sectional view of the connector in a state shown in FIG. 11A.
Figure 12B:
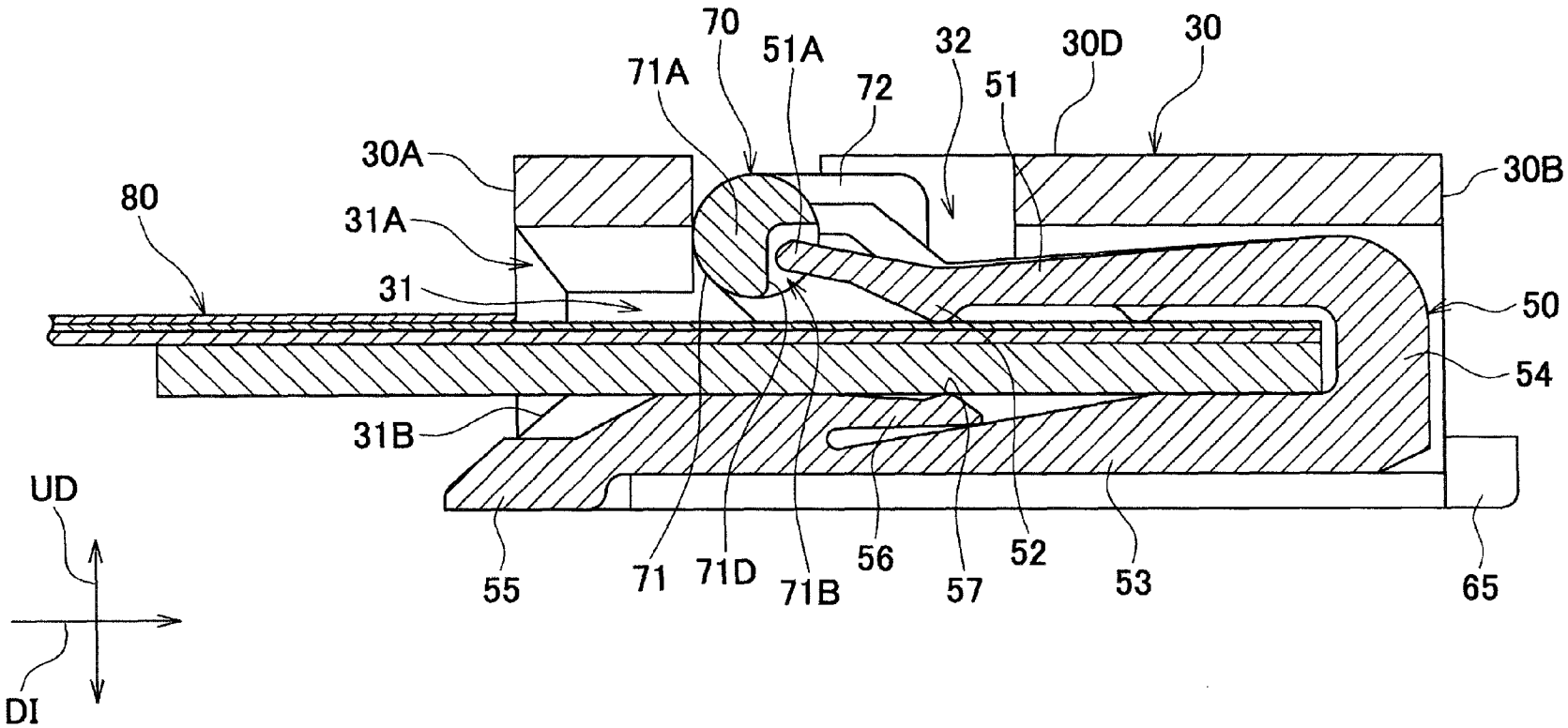
FIG. 12B is a longitudinal cross-sectional view of the connector in a state shown in FIG. 11B.
Figure 12C:
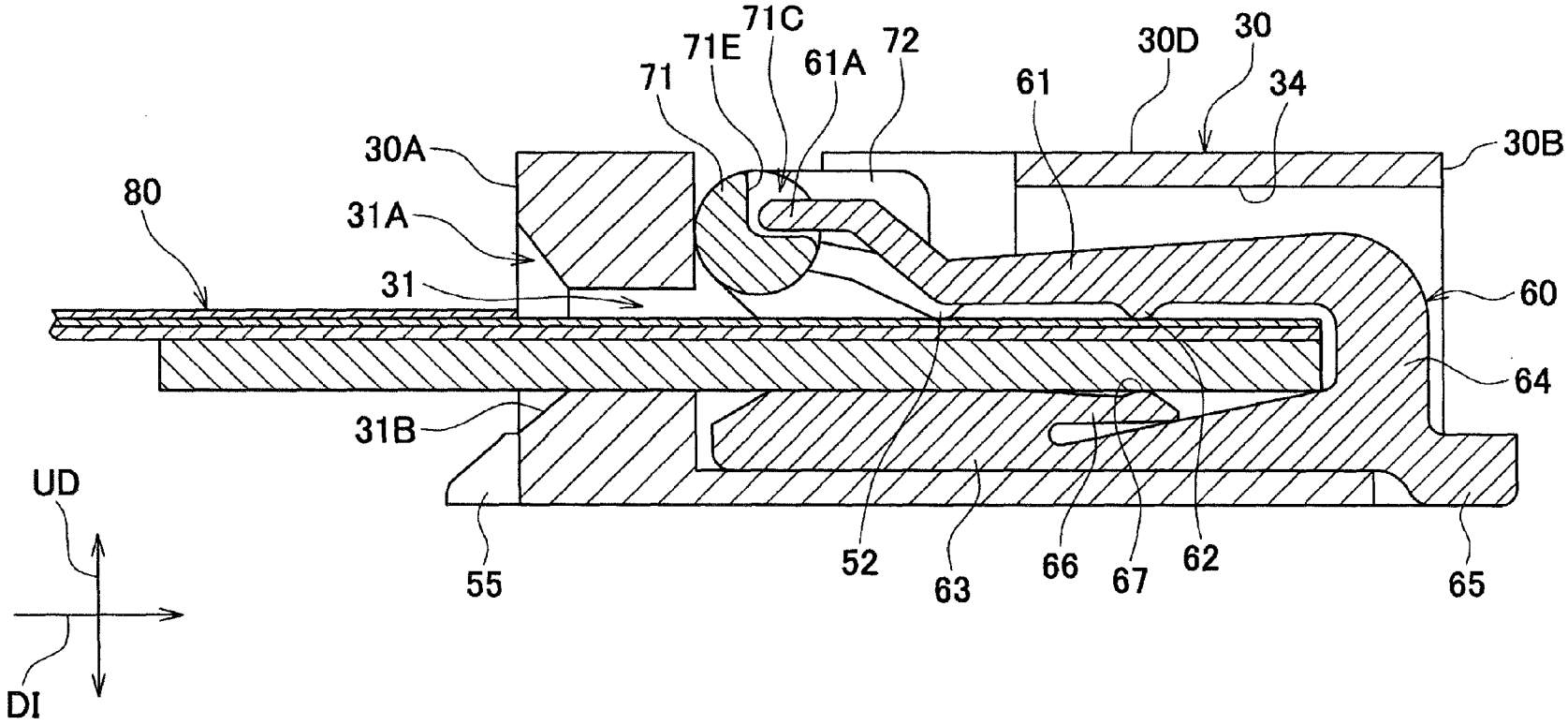
FIG. 12C is a longitudinal cross-sectional view of the connector in a state shown in FIG. 11C.

The receiving portions 35 are recesses for receiving locking portions 72E of abutment portions 72, respectively, when the flexible printed wiring board 80 is inserted to a predetermined position (a position where the receiving portions 85 of the flexible printed wiring board 80 are opposed to the receiving portions 35 of the housing 30, respectively, in a vertical direction UD of the housing 30) in the insertion portion 31 of the housing 30 (see FIG. 12A). The locking portions 72E of the abutment portions 72 are inserted in the receiving portions 35 of the housing 30 through the receiving portions 85 of the flexible printed wiring board 80, respectively, whereby the abutment portions 72 are prevented from rotating (clockwise rotation in FIG. 12A), and the flexible printed wiring board 80 is prevented from moving in a direction opposite to the insertion direction DI.

Figure 2:
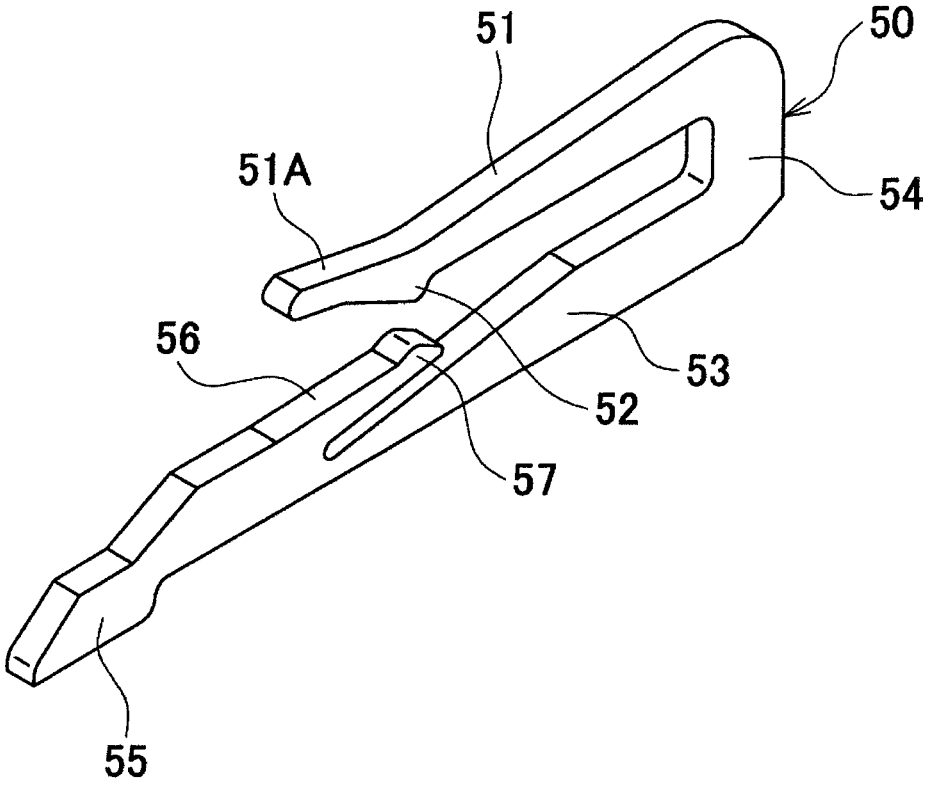
FIG. 2 is a perspective view of a first contact of the connector shown in FIG. 1.
Figure 3:
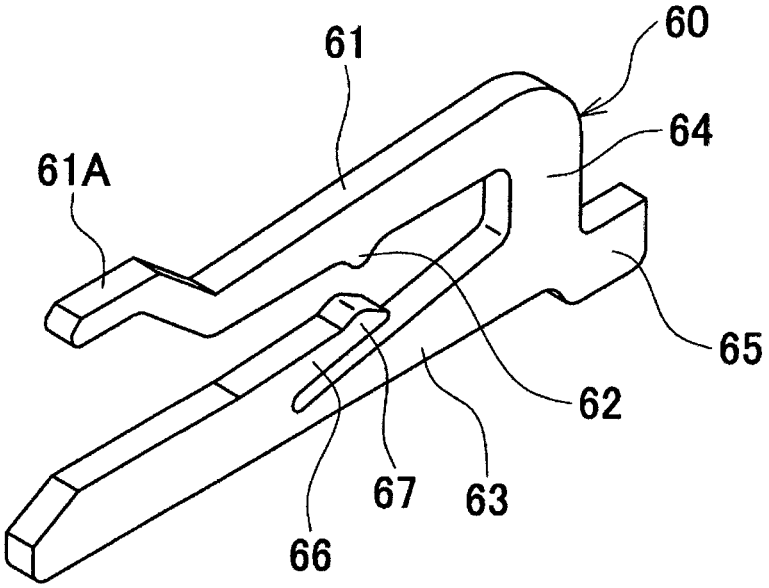
FIG. 3 is a perspective view of a second contact of the connector shown in FIG. 1.

As shown in FIGS. 2 and 3, each first contact 50 and each second contact 60 are contacts of different types. The first contacts 50 are mounted from the front side (the insertion slot 31A) of the housing 30, and the second contacts 60 are mounted from the rear side (rear surface 30B) of the housing 30. The first contacts 50 and the second contacts 60 are formed by blanking a metal plate. The first contacts 50 and the second contacts 60 are alternately arranged at predetermined intervals in the longitudinal direction LH of the housing 30 (see FIG. 1).

Figure 8A:
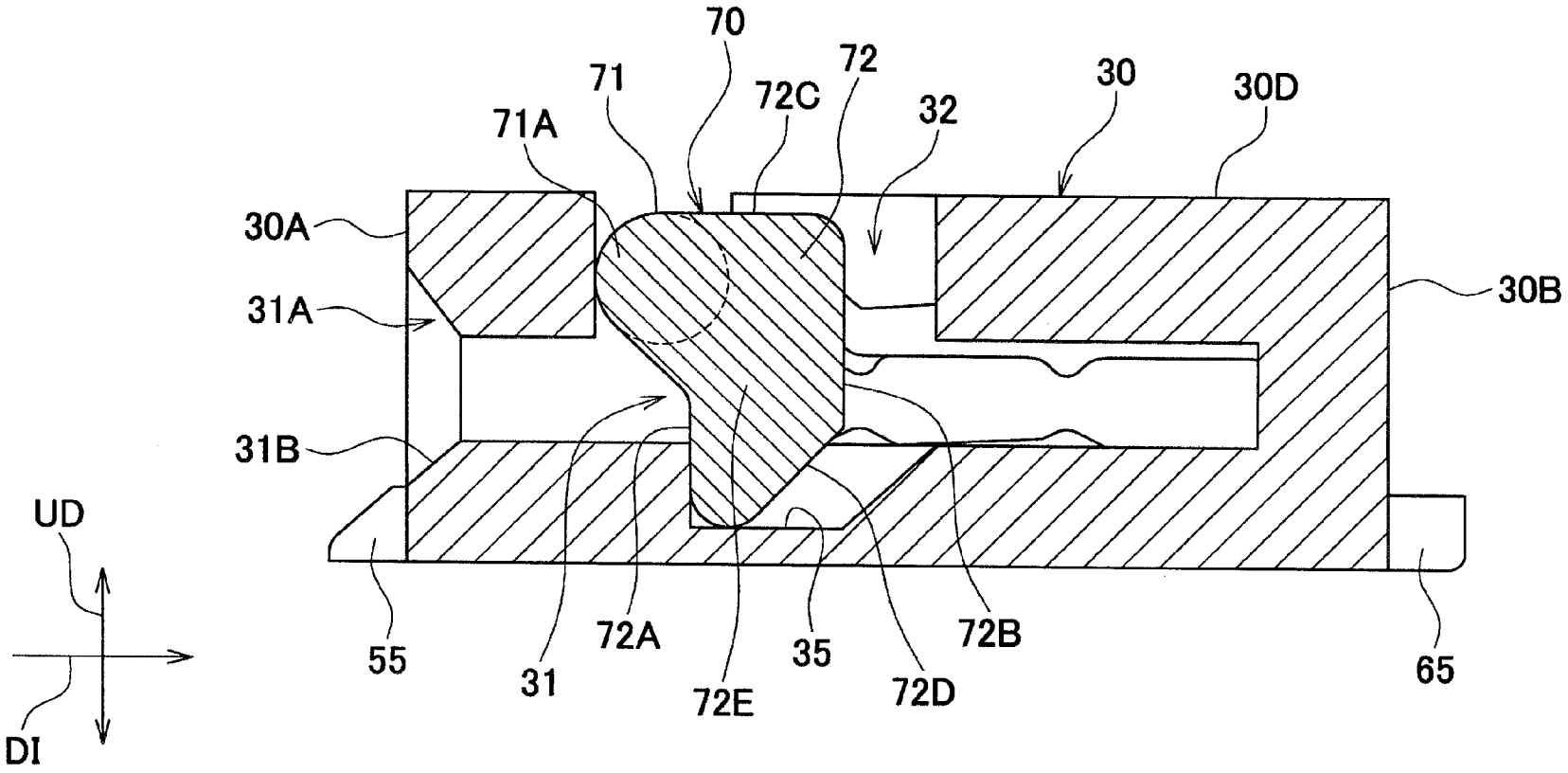
FIG. 8A is a longitudinal cross-sectional view of the connector in a state shown in FIG. 7A.
Figure 8B:
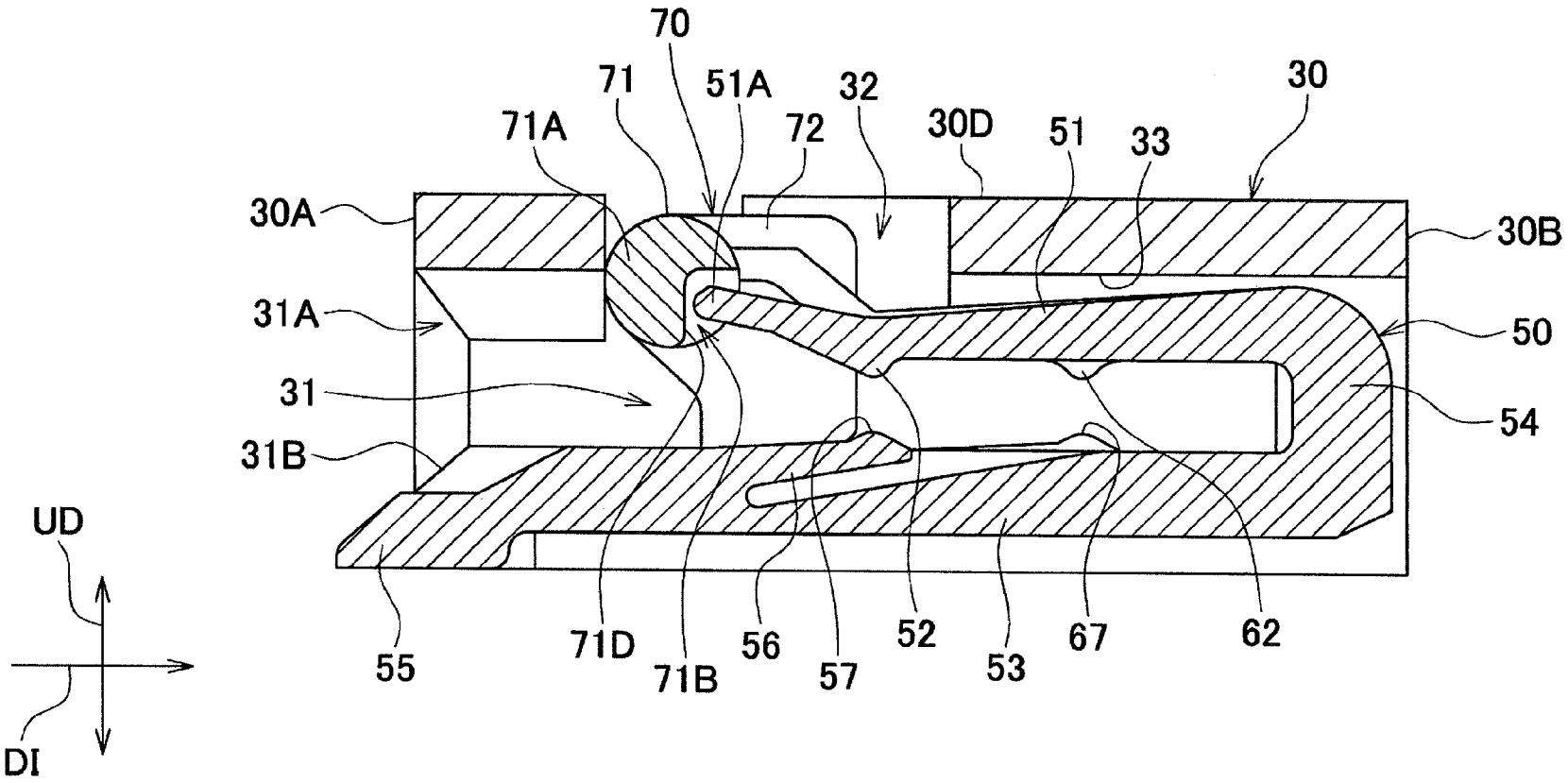
FIG. 8B is a longitudinal cross-sectional view of the connector in a state shown in FIG. 7B.

As shown in FIGS. 2 and 8B, the plurality of first contacts 50 each include a movable arm portion 51 which extends from an inner end of the insertion portion 31 of the housing 30 toward the insertion slot 31A and is elastically deformable, a first contact portion (contact portion) 52 which is formed on the movable arm portion 51 and protrudes into the insertion portion 31, a fixed arm portion 53 which extends from the inner end of the insertion portion 31 of the housing 30 toward the insertion slot 31A, a linking portion 54 which links the fixed arm portion 53 and the movable arm portion 51 at the inner end of the insertion portion 31, and a connection portion 55 which is formed on a front end of the fixed arm portion 53 and is connected to the printed circuit board. A front end portion 51A of the movable arm portion 51 is at a location closer to the insertion slot 31A than the first contact portion 52 is. The connection portion 55 is at a location toward the insertion slot 31A of the housing 30.

Further, the plurality of first contacts 50 each include a spring portion 56 which extends from toward the insertion slot 31A of the insertion portion 31 toward the inner end of the insertion portion 31, and a second contact portion (fixed arm portion-side contact portion) 57 which is formed on the spring portion 56 in a manner opposed to the first contact portion 52, and protrudes into the insertion portion 31. The spring portion 56 is formed on the fixed arm portion 53.

Figure 8C:
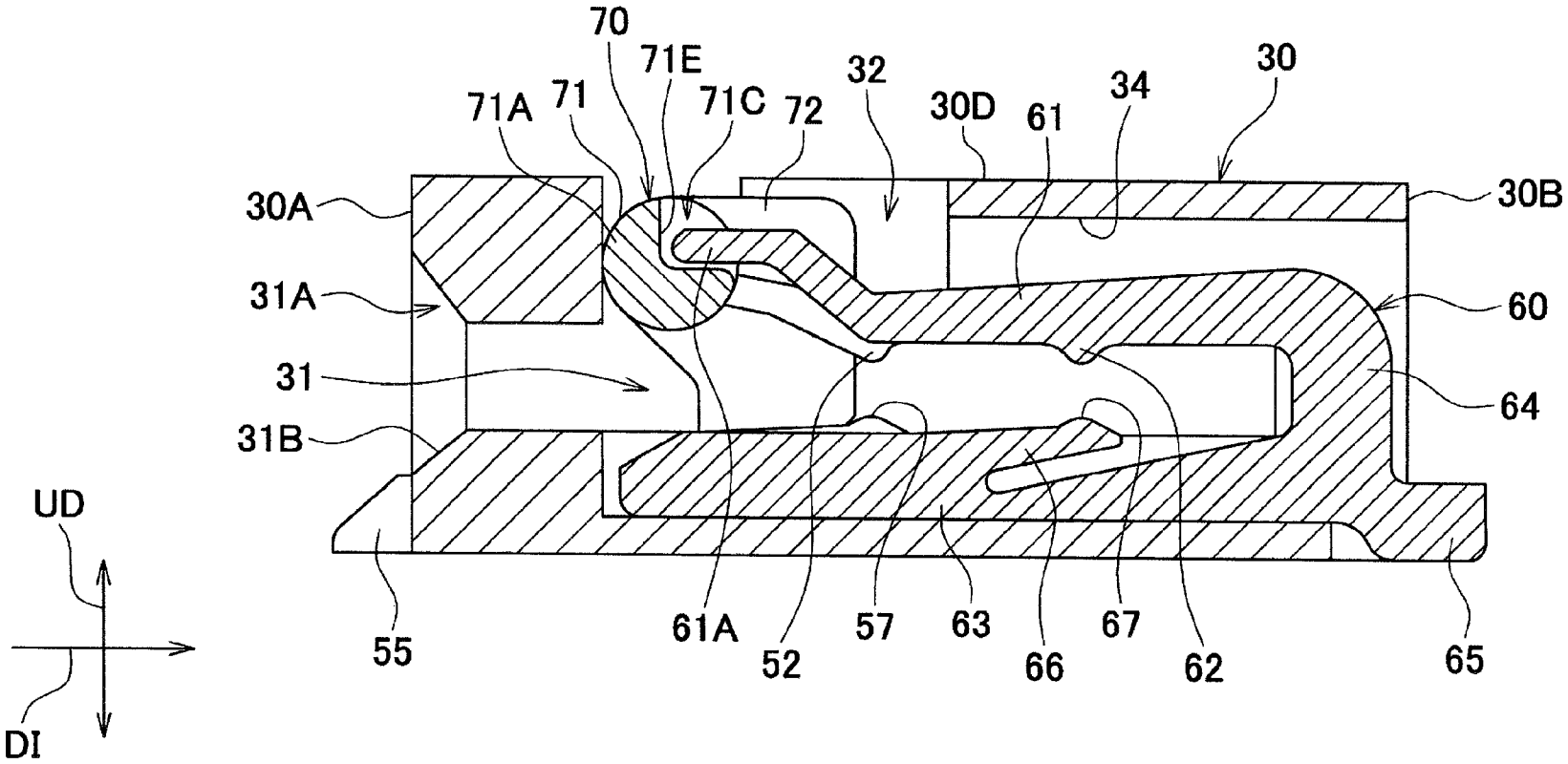
FIG. 8C is a longitudinal cross-sectional view of the connector in a state shown in FIG. 7C.

As shown in FIGS. 3 and 8C, the plurality of second contacts 60 each include a movable arm portion 61 which extends from the inner end of the insertion portion 31 of the housing 30 toward the insertion slot 31A, a first contact portion (contact portion) 62 which is formed on the movable arm portion 61 and protrudes into the insertion portion 31, a fixed arm portion 63 which extends from the inner end of the insertion portion 31 of the housing 30 toward the insertion slot 31A, a linking portion 64 which links the fixed arm portion 63 and the movable arm portion 61 at the inner end of the insertion portion 31, and a connection portion 65 which is formed on a rear end of the fixed arm portion 63 and is connected to the printed circuit board. A front end portion 61A of the movable arm portion 61 is at a location closer to the insertion slot 31A than the first contact portion 62 is. The connection portion 65 is at a location toward the rear surface 30B of the housing 30.

Further, the plurality of second contacts 60 each include a spring portion 66 which extends from toward the insertion slot 31A of the insertion portion 31 toward the inner end of the insertion portion 31, and a second contact portion (fixed arm portion-side contact portion) 67 which is formed on the spring portion 66 in a manner opposed to the first contact portion 62 and protrudes into the insertion portion 31. The spring portion 66 is formed on the fixed arm portion 63.

As shown in FIGS. 8B and 8C, the positions of the first contact portion 52 of each first contact 50 and the first contact portion 62 of each second contact 60 are displaced in the direction DI of inserting the flexible printed wiring board 80. Similarly, the positions of the second contact portion 57 of each first contact 50 and the second contact portion 67 of each second contact 60 are displaced in the direction DI of inserting the flexible printed wiring board 80.

Figure 4:
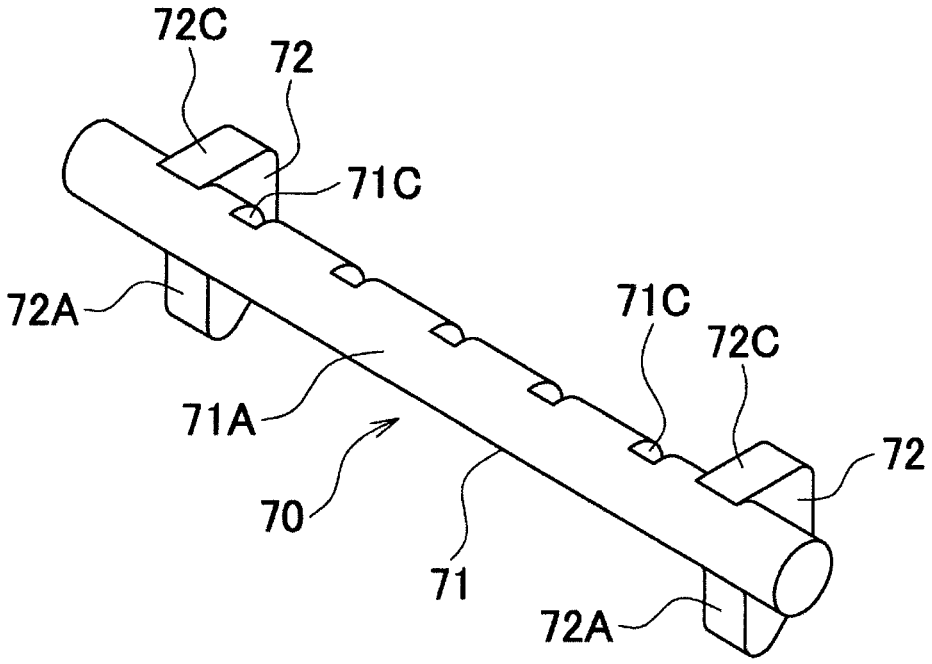
FIG. 4 is a perspective view of an operation member of the connector shown in FIG. 1, as viewed obliquely from the front.
Figure 5:
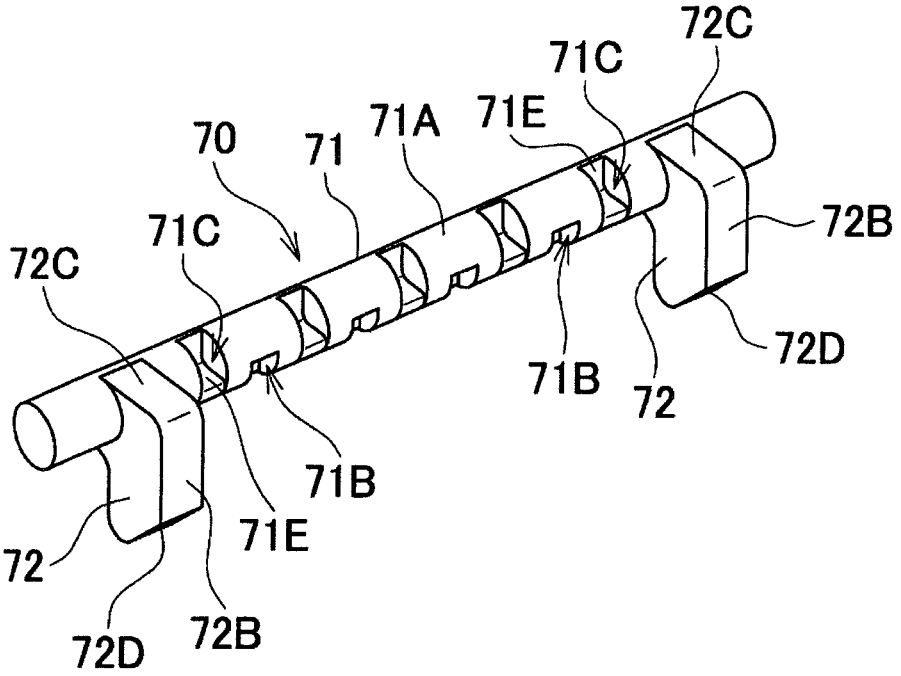
FIG. 5 is a perspective view of the operation member of the connector shown in FIG. 1, as viewed obliquely from the rear.

As shown in FIGS. 4 and 5, the operation member 70 includes an operation portion 71 which operates the movable arm portions 51 and 61 of the first contacts 50 and the second contacts 60, the abutment portions 72 which are linked to the operation portion 71 and are pushed and rotated by the flexible printed wiring board 80 inserted into the insertion slot 31A of the housing 30 to thereby transmit a rotational force to the operation portion 71. The operation member 70 is made of insulating resin.

As shown in FIGS. 4, 5, 8B, and 8C, the operation portion 71 includes a body 71A having a cylindrical shape, first recesses 71B which are formed in the body 71A to receive the front end portions 51A of the movable arm portions 51 of the first contacts 50, respectively, and second recesses 71C which are formed in the body 71A to receive the front end portions 61A of the movable arm portions 61 of the second contacts 60, respectively. Opposite ends of the body 71A are rotatably supported by the bearing portions 32A of the housing 30 (see FIG. 1), respectively. The abutment portions 72 are provided in the vicinity of the opposite ends of the body 71A. The first recesses 71B and the second recesses 71C are alternately arranged at predetermined intervals in a longitudinal direction of the body 71A. The position of each first recess 71B and the position of each second recess 71C are displaced by 90 degrees in a circumferential direction of the body 71A. The meaning of "90 degrees" mentioned here includes not only strictly 90 degrees but also approximately 90 degrees, i.e. around 90 degrees.

As shown in FIGS. 1 and 8A, the abutment portions 72 are positioned closer to the inner end of the insertion portion 31 of the housing 30 than the operation portion 71 is. Each abutment portion 72 includes the locking portion 72E. When the flexible printed wiring board 80 is inserted to the predetermined position in the insertion portion 31 of the housing 30, the locking portions 72E are caused to enter the receiving portions 85 of the flexible printed wiring board 80, respectively (see FIG. 12A), and are prevented from moving in the direction opposite to the direction DI of inserting the flexible printed wiring board 80. Each abutment portion 72 further includes a front surface 72A, a rear surface 72B, a top surface 72C, and an inclined surface 72D. The front surface 72A and the rear surface 72B are substantially parallel to each other. An angle formed by the rear surface 72B and the top surface 72C is approximately 90 degrees. A lower end of the inclined surface 72D is continuous with a lower end of the front surface 72A, and an upper end of the inclined surface 72D is continuous with a lower end of the rear surface 72B. An angle formed by the inclined surface 72D and the rear surface 72B is an obtuse angle.

Next, a description will be given of how to assemble the connector 10 of the present embodiment.

First, the plurality of first contacts 50 are press-fitted into the first contact-accommodating chambers 33 from the front (left side as viewed in FIG. 7B) of the housing 30, respectively.

Next, the operation member 70 is inserted into the accommodation portion 32 from the top (upper side as viewed in FIG. 7A) of the housing 30, and the opposite ends of the body 71A of the operation member 70 are caused to be supported by the bearing portions 32A of the housing 30, respectively (see FIG. 1).

Finally, the plurality of second contacts 60 are press-fitted into the second contact-accommodating chambers 34 from the rear (right side as viewed in FIG. 7C) of the housing 30, respectively.

Following the above-described procedure, the assembly of the connector 10 is completed.

Next, a description will be given of operation of the connector 10 of the present embodiment with reference to FIGS. 7A to 12C.

Figure 7C:
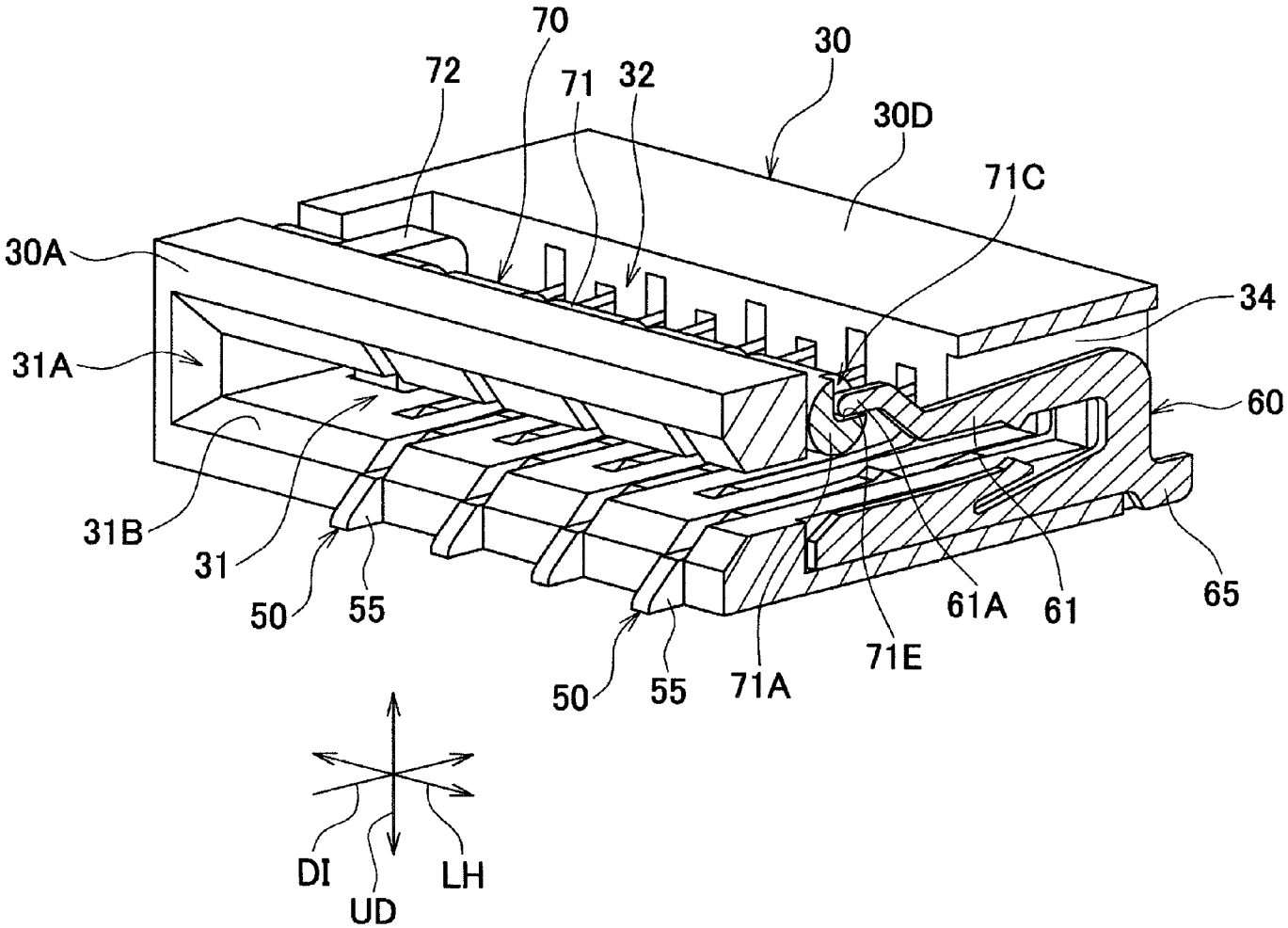
FIG. 7C is a partially cut-away perspective view of the connector before having the flexible printed wiring board connected thereto, with a section of the second contact.

Before the flexible printed wiring board 80 is inserted into the insertion portion 31 of the housing 30, the top surfaces 72C of the abutment portions 72 of the operation member 70 are parallel to the top surface 30D of the housing 30 (see FIGS. 7A and 8A), inner surfaces 71D of the first recesses 71B of the operation member 70 and the front ends 51A of the movable arm portions 51 of the first contacts 50 are not in contact with each other (see FIGS. 7B and 8B), respectively, and inner surfaces 71E of the second recesses 71C of the operation member 70 and the front ends 61A of the movable arm portions 61 of the second contacts 60 are not in contact with each other, respectively (see FIGS. 7C and 8C).

Figure 9A:
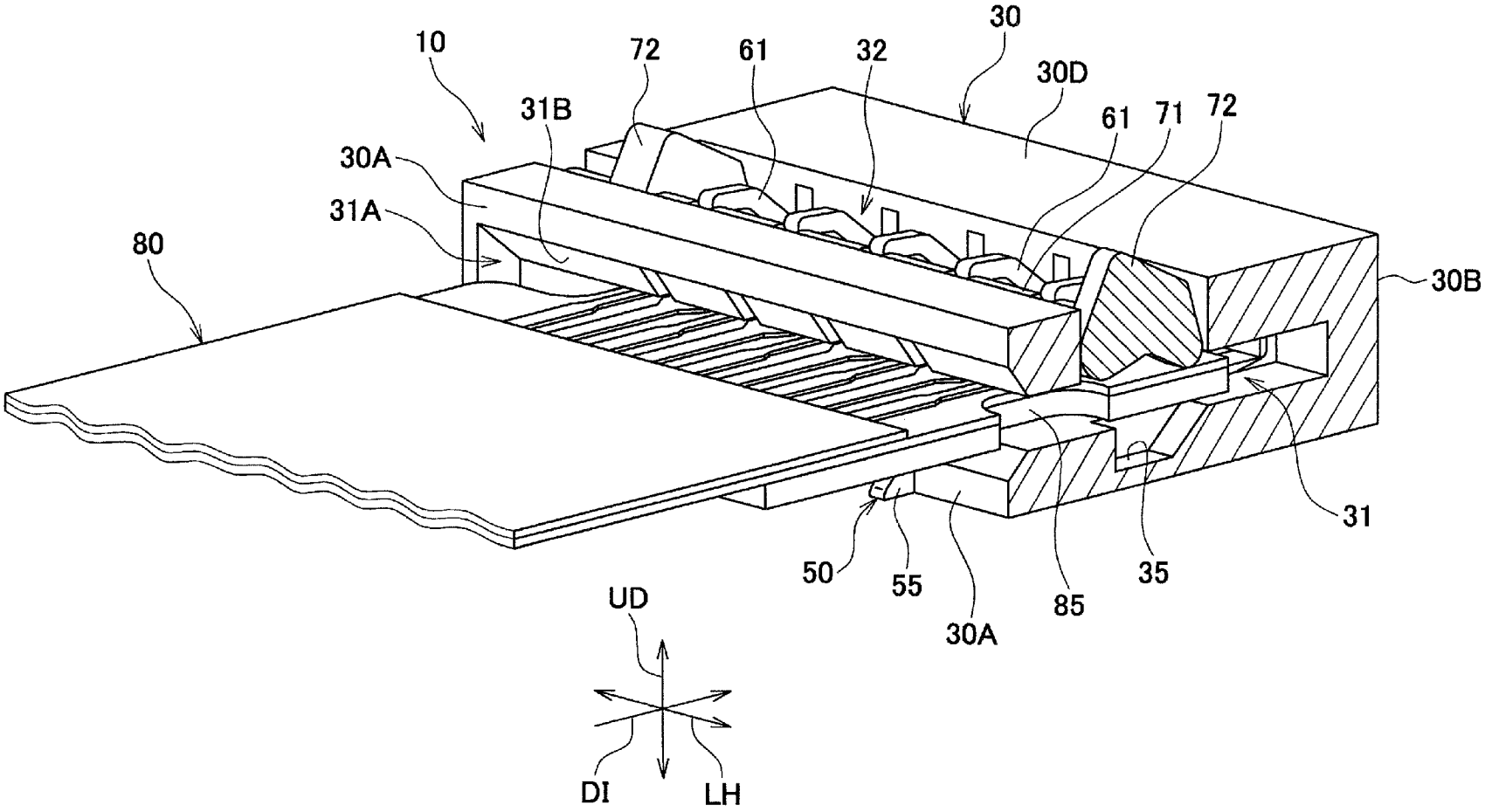
FIG. 9A is a partially cut-away perspective view of the connector having the flexible printed wiring board halfway inserted into an insertion portion thereof, with a section of the abutment portion.
Figure 9B:
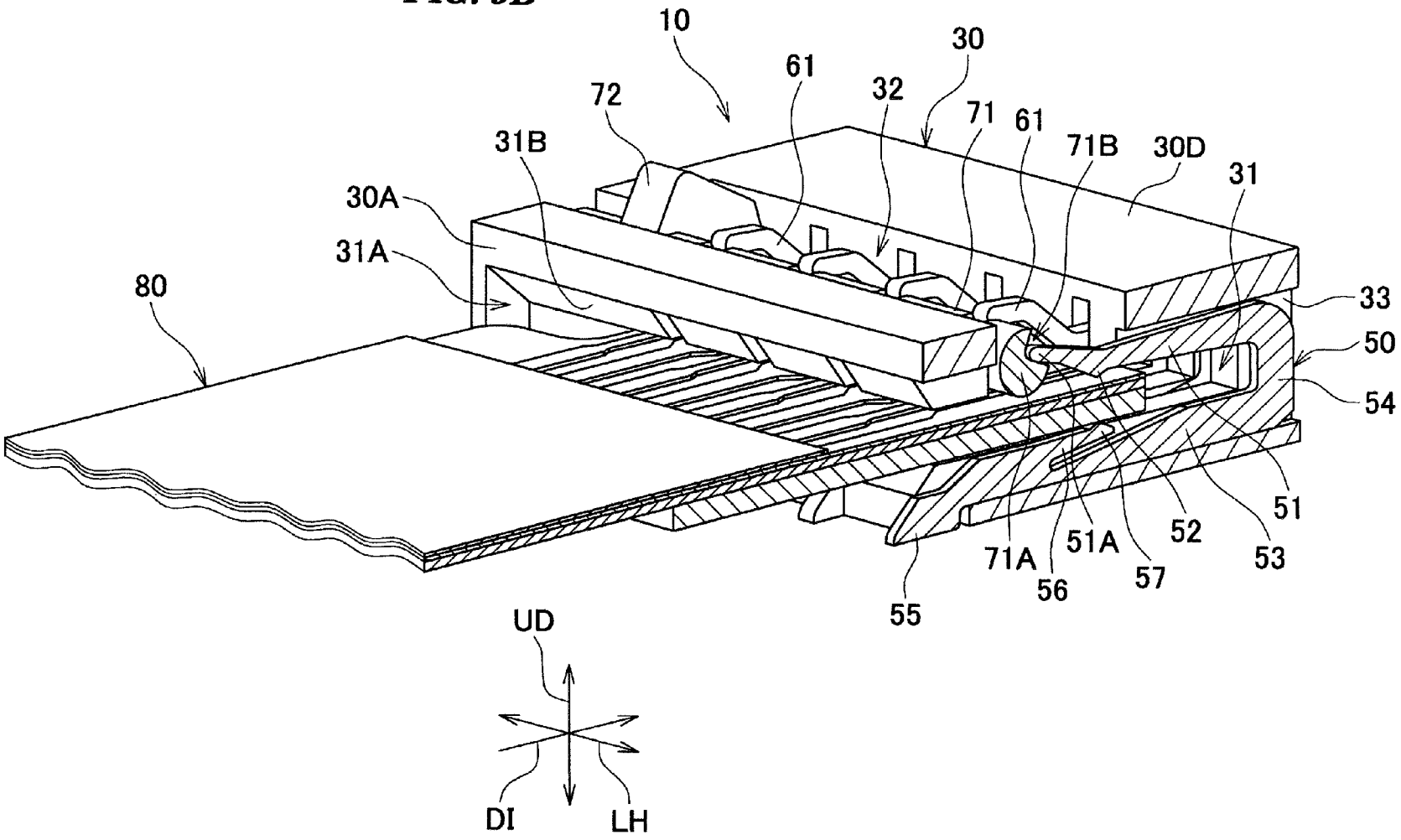
FIG. 9B is a partially cut-away perspective view of the connector having the flexible printed wiring board halfway inserted into the insertion portion thereof, with a section of the first contact.
Figure 9C:
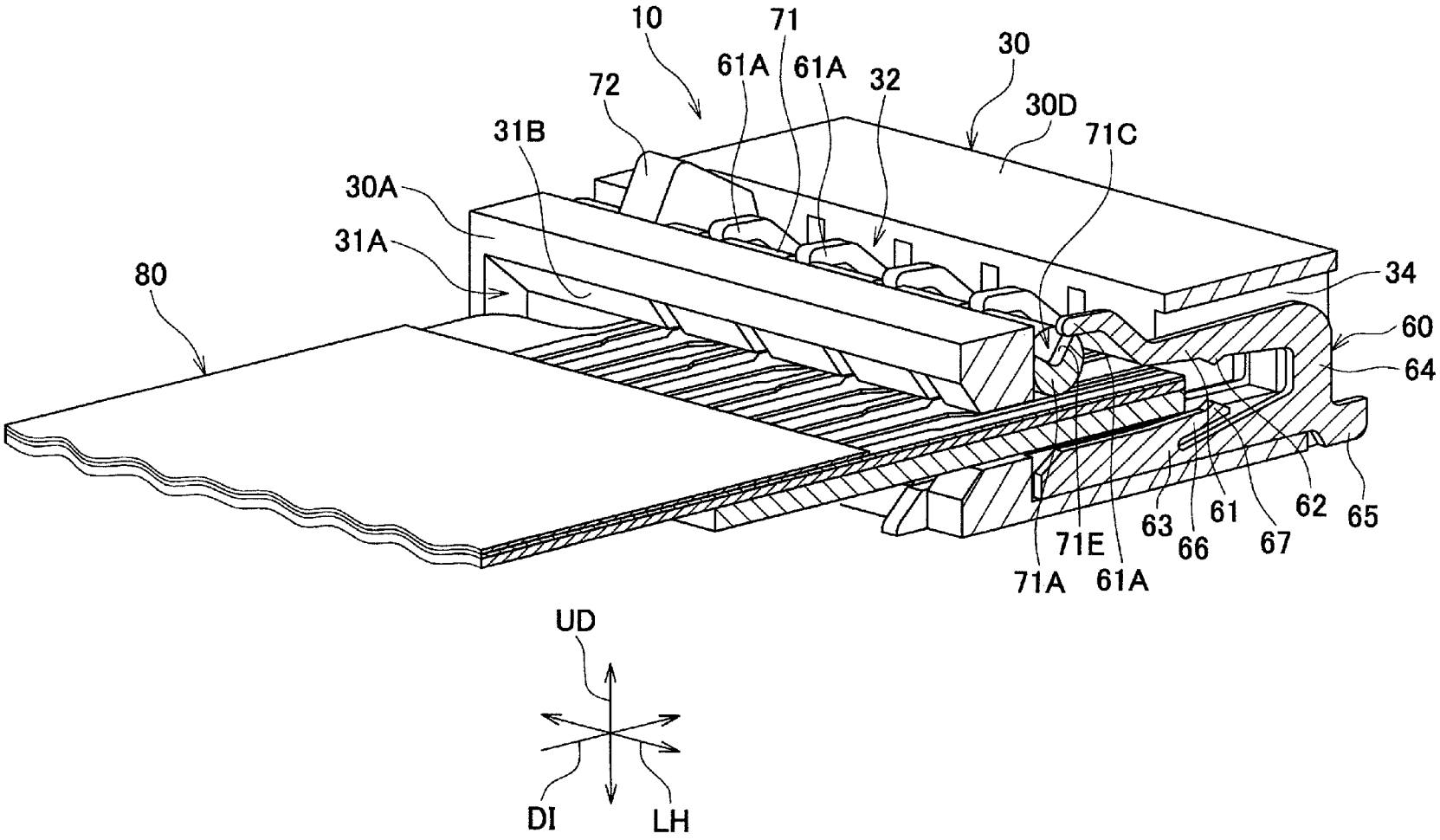
FIG. 9C is a partially cut-away perspective view of the connector having the flexible printed wiring board halfway inserted into the insertion portion thereof, with a section of the second contact.
Figure 10A:
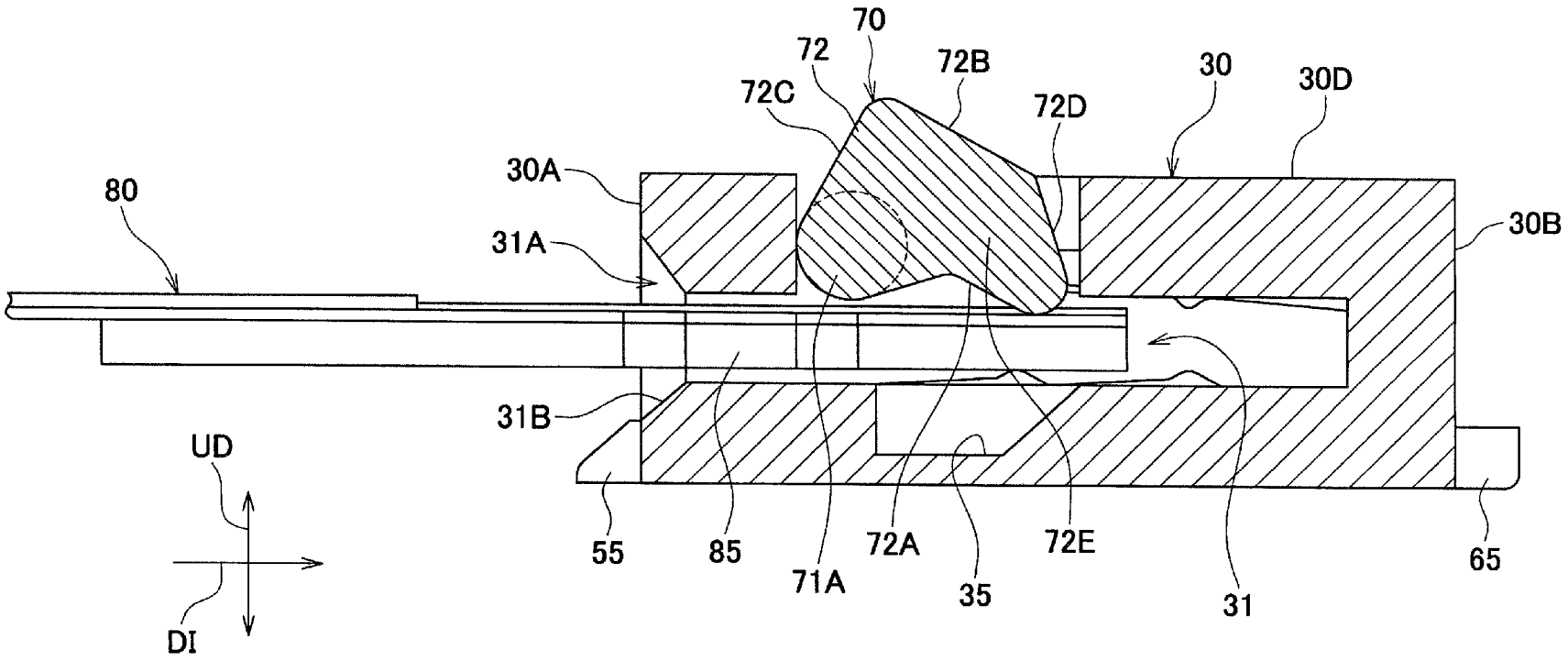
FIG. 10A is a longitudinal cross-sectional view of the connector in a state shown in FIG. 9A.
Figure 10B:
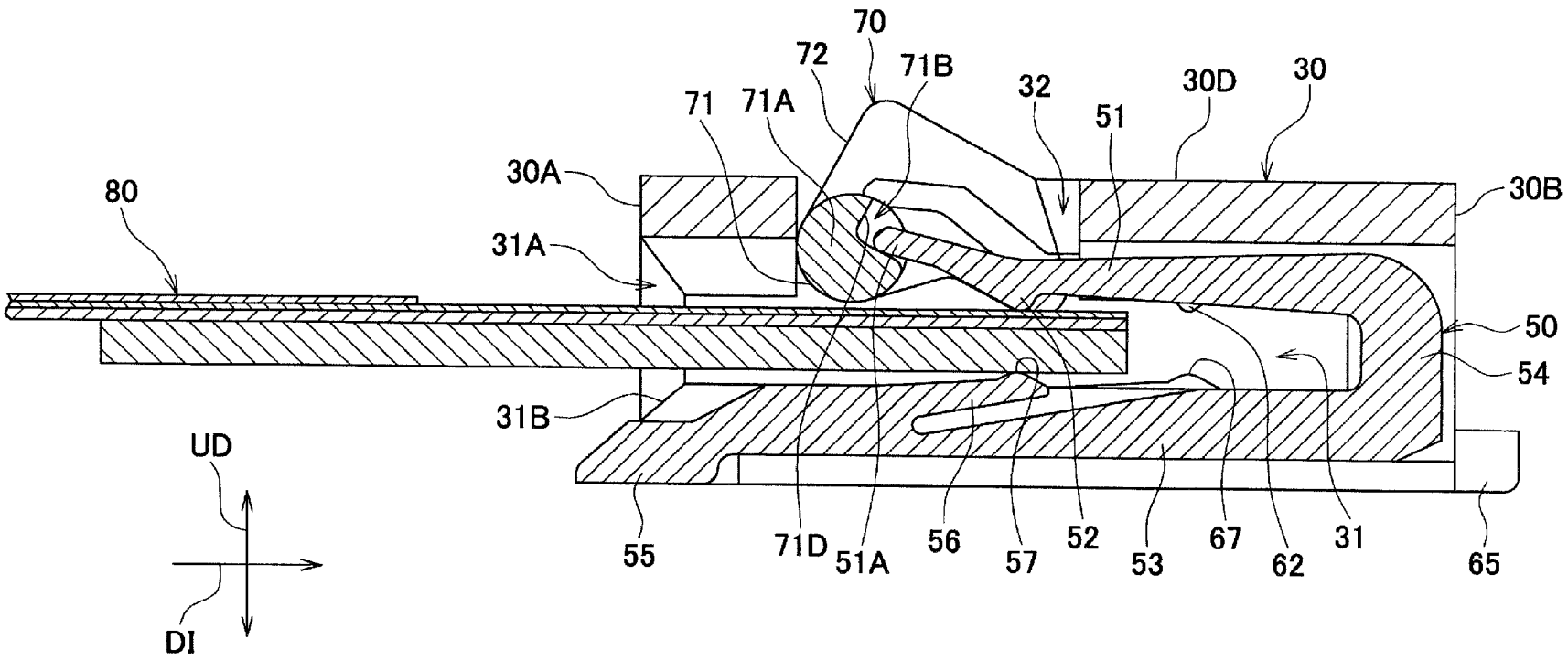
FIG. 10B is a longitudinal cross-sectional view of the connector in a state shown in FIG. 9B.
Figure 10C:
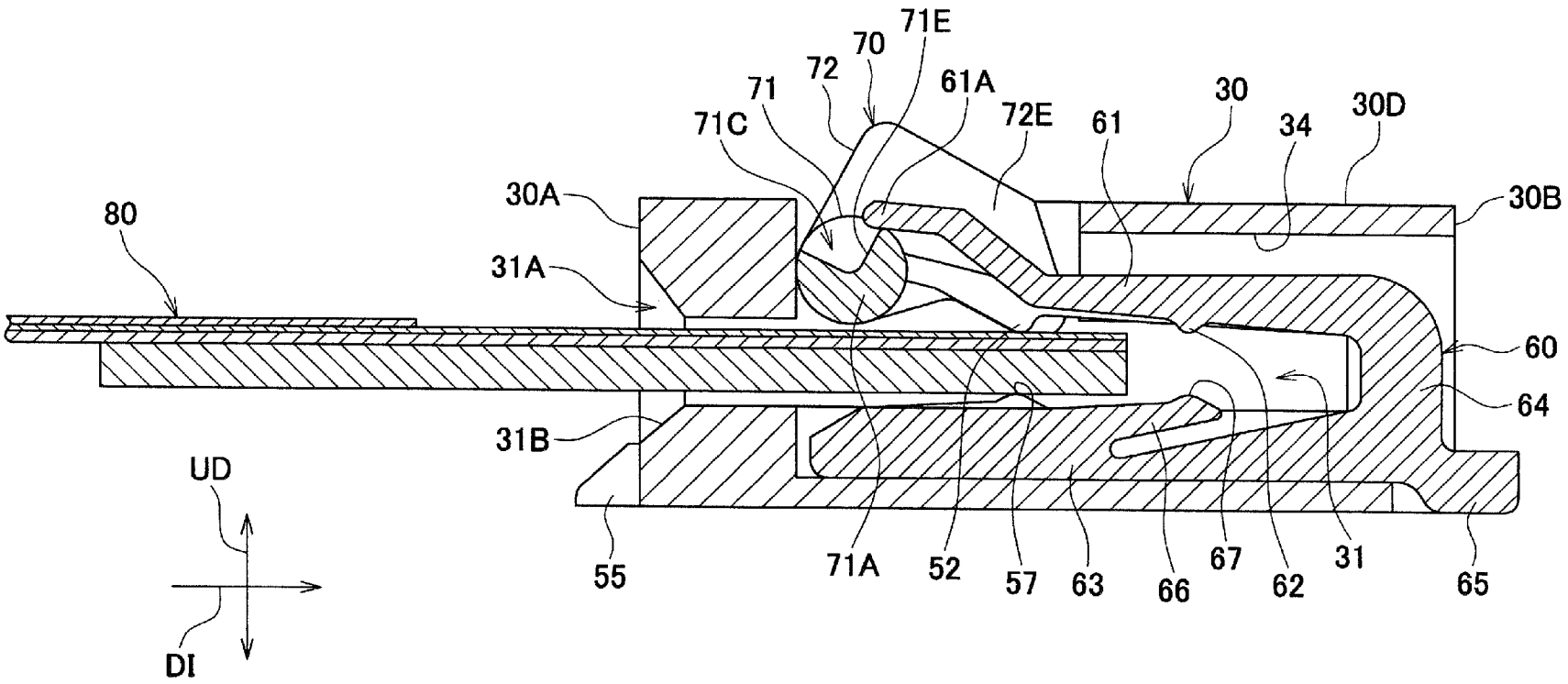
FIG. 10C is a longitudinal cross-sectional view of the connector in a state shown in FIG. 9C.

When the flexible printed wiring board 80 is inserted into the insertion slot 31A of the insertion portion 31 of the housing 30, the abutment portions 72 of the operation member 70 are pushed and rotated by the flexible printed wiring board 80, and are moved in a direction away from the insertion portion 31 of the housing 30 (see FIGS. 9A and 10A). When the operation portion 71 is rotated along with rotation of the abutment portions 72 (rotation in an anti-clockwise direction, as viewed in FIG. 10B), the front ends 51A of the movable arm portions 51 of the first contact 50 are pressed by the inner surfaces 71D of the first recesses 71B, respectively, and are moved in a direction away from the insertion portion 31 (see FIGS. 9B and 10B). Similarly, the front ends 61A of the movable arm portions 61 of the second contacts 60 are pressed by the inner surfaces 71E of the second recesses 71C, respectively, and are moved in the direction away from the insertion portion 31 (see FIGS. 9C and 10C). As a result, a space between the first contact portion 52 and the second contact portion 57 of each first contact 50 is increased (see FIGS. 9B and 10B), and a space between the first contact portion 62 and the second contact portion 67 of each second contact 60 is increased (see FIGS. 9C and 10C). Therefore, the flexible printed wiring board 80 can be inserted into the insertion portion 31 of the housing 30 with a small force, or with no insertion force (very small insertion force).

Figure 11A:
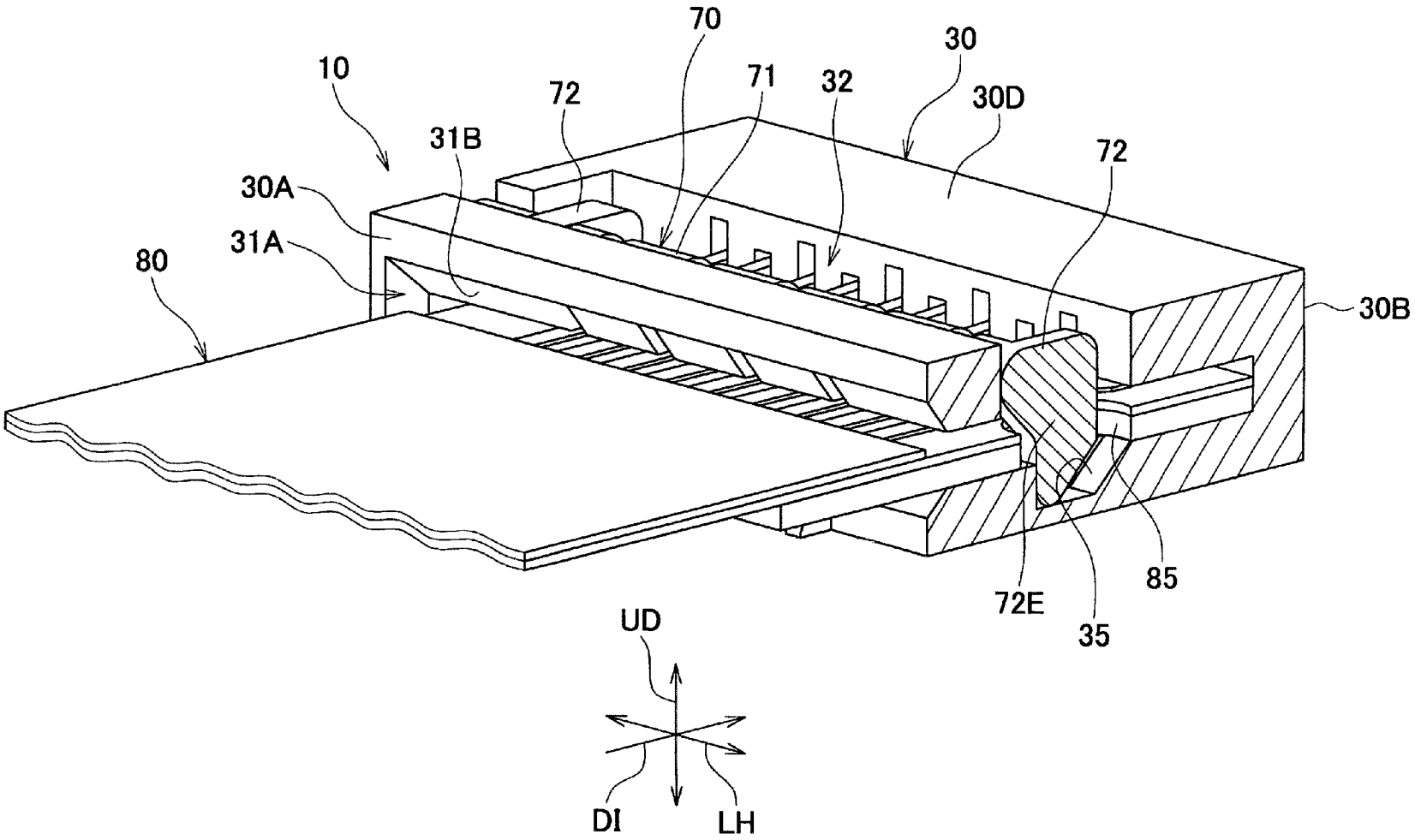
FIG. 11A is a partially cut-away perspective view of the connector having the flexible printed wiring board fully inserted into the insertion portion thereof, with a section of the abutment portion.
Figure 11B:
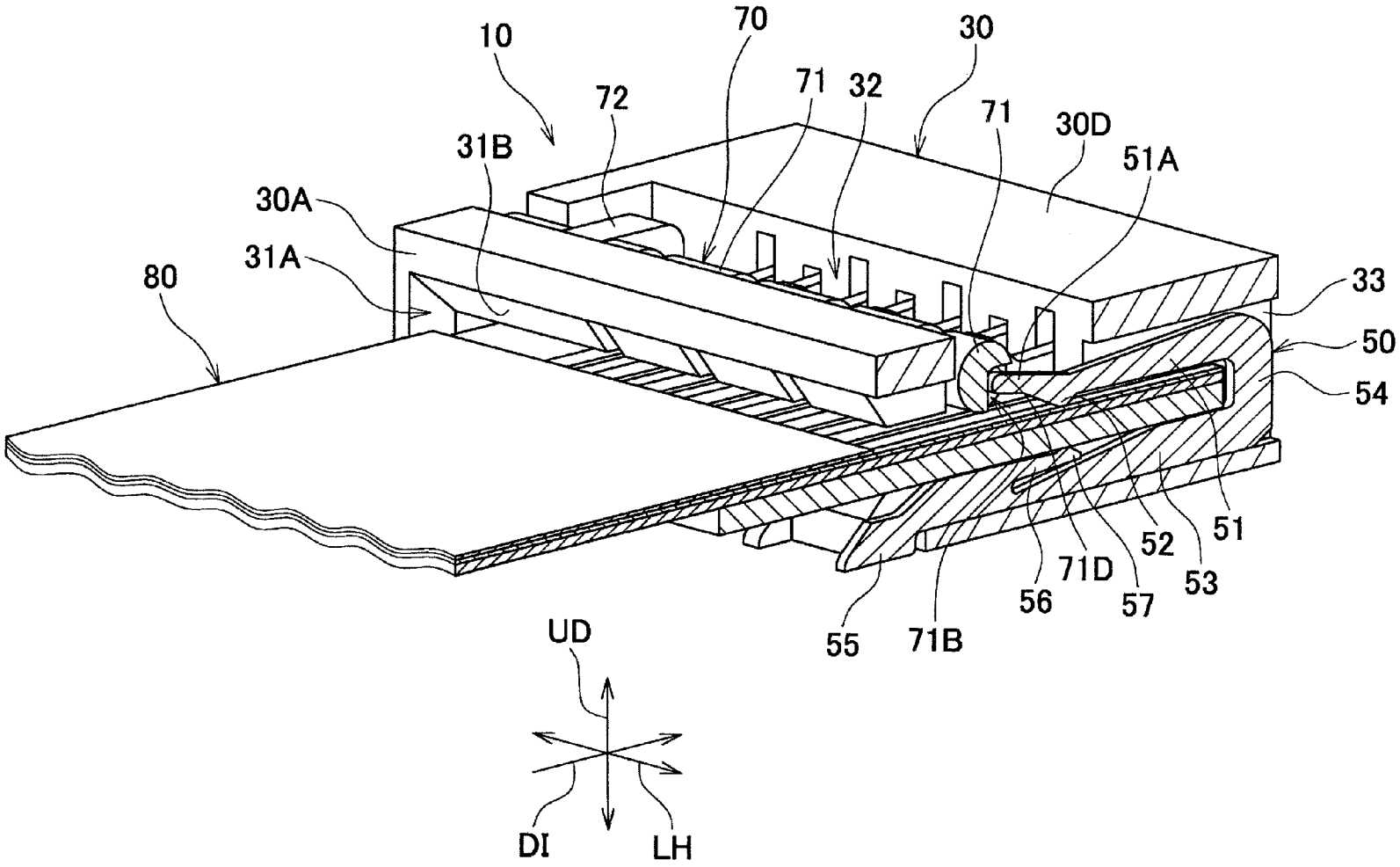
FIG. 11B is a partially cut-away perspective view of the connector having the flexible printed wiring board fully inserted into the insertion portion thereof, with a section of the first contact.
Figure 11C:
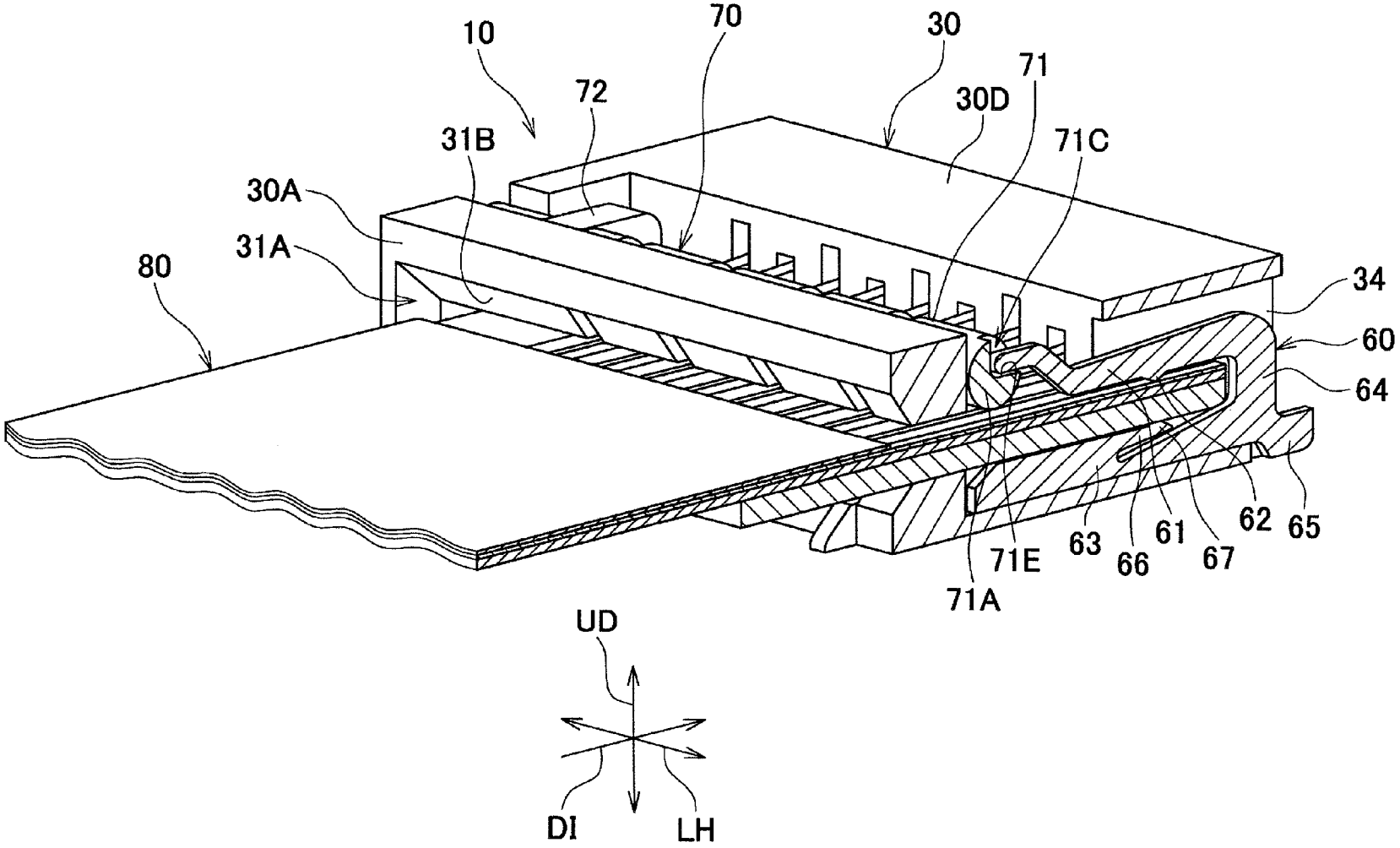
FIG. 11C is a partially cut-away perspective view of the connector having the flexible printed wiring board fully inserted into the insertion portion thereof, with a section of the second contact.

When the flexible printed wiring board 80 is further inserted to cause the receiving portions 85 of the flexible printed wiring board 80 to become opposed to the receiving portions 35 of the housing 30 in the vertical direction UD of the housing 30, respectively, the locking portions 72E of the abutment portions 72 of the operation member 70 enter the receiving portions 35 of the housing 30 through the receiving portions 85 of the flexible printed wiring board 80, respectively (see FIGS. 11A and 12A). At this time, the operation portion 71 is rotated in an opposite direction (clockwise direction as viewed in FIG. 12B), whereby the front ends 51A of the movable arm portions 51 of the first contacts 50 are brought out of contact with the inner surfaces 71D of the first recesses 71B, respectively, and are moved into the insertion portion 31 by the returning force of the movable arm portions 51 (see FIGS. 11B and 12B). Similarly, the front ends 61A of the movable arm portions 61 of the second contacts 60 are brought out of contact with the inner surfaces 71E of the second recesses 71C, respectively, and are moved into the insertion portion 31 by the returning force of the movable arm portions 61 (see FIGS. 11C and 12C). As a result, the space between the first contact portion 52 and the second contact portion 57 of each first contact 50 is reduced (see FIGS. 11B and 12B), and the space between the first contact portion 62 and the second contact portion 67 of each second contact 60 is reduced (see FIGS. 11C and 12C), whereby the first contact portions 52 of the first contacts 50 are brought into contact with the terminal portions 82A of the flexible printed wiring board 80, respectively, and the first contact portions 62 of the second contacts 60 are brought into contact with the terminal portions 82A' of the flexible printed wiring board 80, respectively. Thus, the flexible printed wiring board 80 and the printed circuit board are electrically connected to each other.

In a state in which the flexible printed wiring board 80 has been connected to the connector 10 (state shown in FIG. 12A), if an attempt is made to pull the flexible printed wiring board 80 out of the connector 10, the inner surfaces of the receiving portions 85 of the flexible printed wiring board 80 are brought into abutment with the rear surfaces 72B of the abutment portions 72 of the operation member 70, respectively, and the flexible printed wiring board 80 pushes the rear surfaces 72B of the abutment portions 72 of the operation member 70 in a direction opposite to the insertion direction DI, but the locking portions 72E of the abutment portions 72 have been deeply fitted in the receiving portions 35 of the housing 30, and hence the front surfaces 72A of the locking portions 72E of are brought into abutment with the inner surfaces of the receiving portions 35 of the housing 30, respectively. Therefore, the abutment portions 72 are hardly rotated, and hence the flexible printed wiring board 80 is positively prevented from moving in the direction opposite to the insertion direction DI.

According to the present embodiment, even when a large force acting to pull the flexible printed wiring board 80 out of the connector 10 is generated due to some cause, the flexible printed wiring board 80 is difficult to be removed from the connector 10.

Further, the connector 10 employs a structure in which the abutment portions 72 of the operation member 70 are arranged at respective locations rearward of the operation portion 71 (toward the inner end of the insertion portion 31), and the flexible printed wiring board 80 is brought into contact with the abutment portions 72 only when the flexible printed wiring board 80 is inserted into the insertion portion 31 of the housing 30 to a certain extent, and hence it is possible to smoothly insert the flexible printed wiring board 80 into the insertion portion 31, ensuring good insertability of the flexible printed wiring board 80 into the housing 30.

Further, since the positions of the first contact portion 52 of each first contact 50 and the first contact portion 62 of each first contact 60 are displaced in the insertion direction DI, it is possible to reduce the arrangement pitch of the first contacts 50 and the second contacts 60, which makes it possible to reduce the size of the connector 10 in the longitudinal direction LH.

Further, since the first contact portions 52 and 62 and the second contact portions 57 and 67 are formed on the movable arm portions 51 and 61, respectively, when the flexible printed wiring board 80 is inserted into the insertion portion 31, the flexible printed wiring board 80 and the printed circuit board can be electrically connected to each other irrespective of which of the surfaces of the flexible printed wiring board 80 where the terminal portions 82A and 82A' are provided respectively is set to be the upper surface.

To pull the flexible printed wiring board 80 out of the housing 30 in a state in which the flexible printed wiring board 80 has been locked by the locking portions 72E, the operation portion 71 or the abutment portions 72 is/are rotated using e.g. a jig, not shown, to release the state of the flexible printed wiring board 80 locked by the locking portions 72E, and then the flexible printed wiring board 80 is pulled out of the housing 30.

Figure 15:
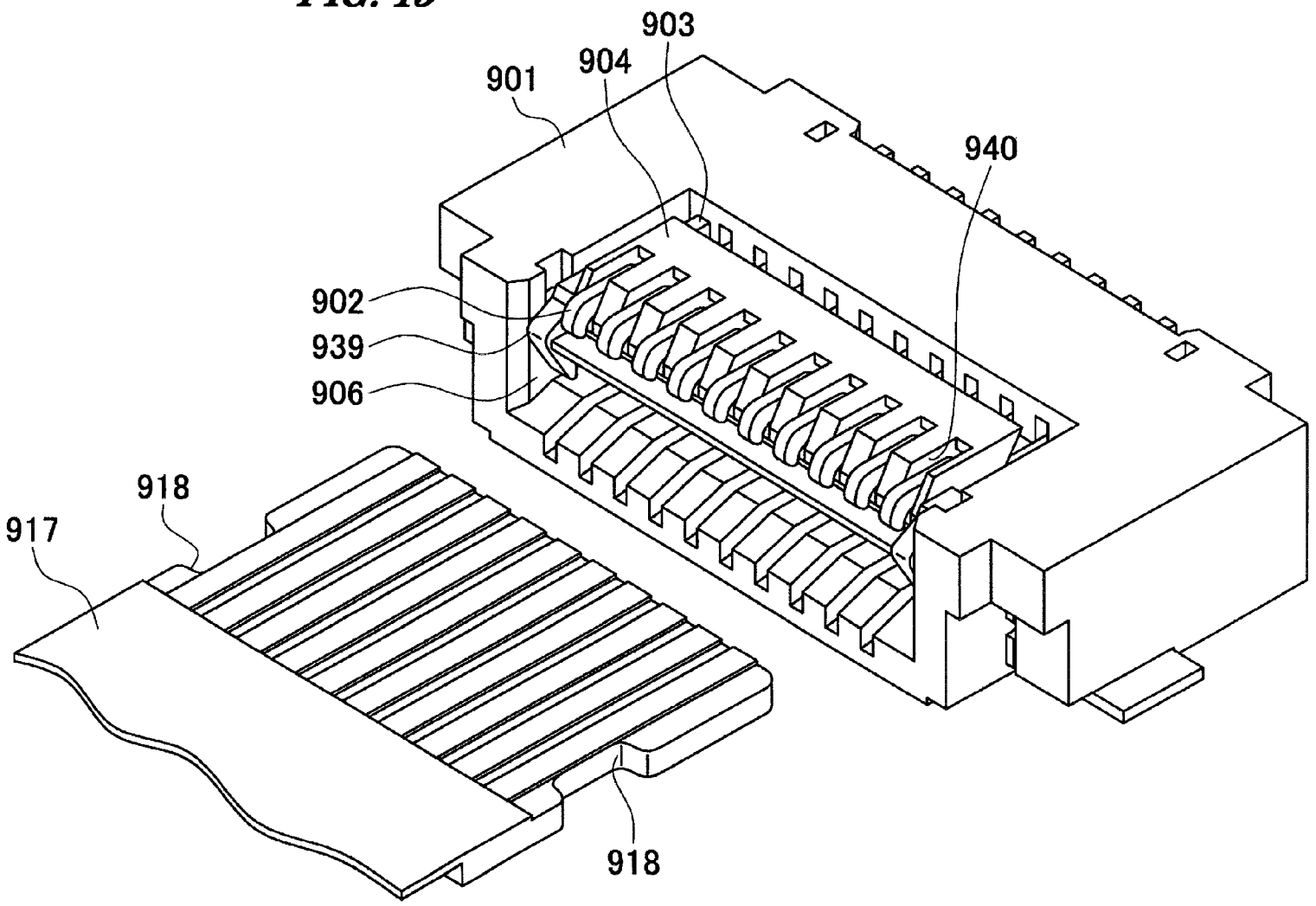
FIG. 15 is a perspective view of a conventional connector before having a board fitted therein.
Figure 16:
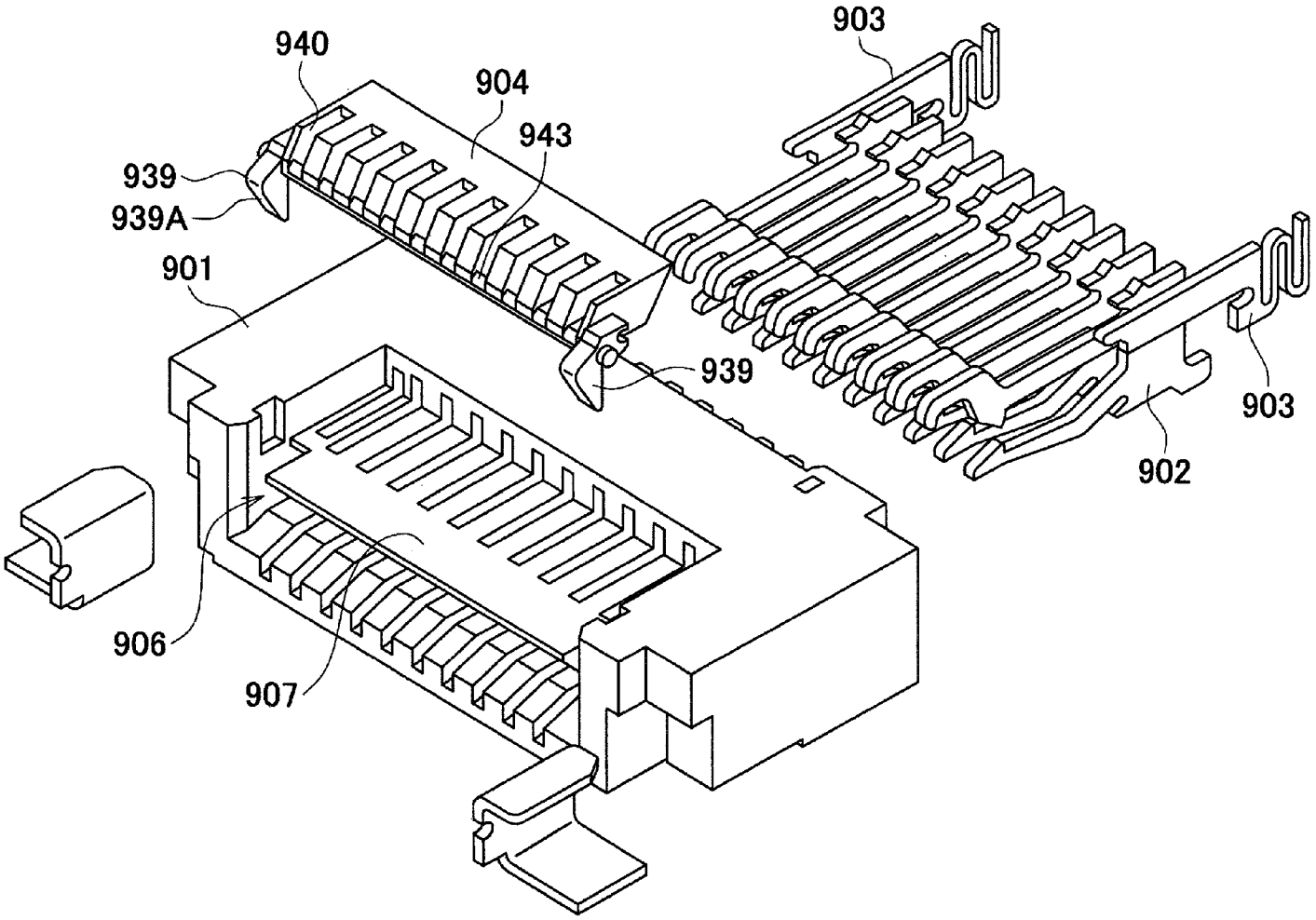
FIG. 16 is an exploded perspective view of the connector appearing in FIG. 15.
Figure 17:
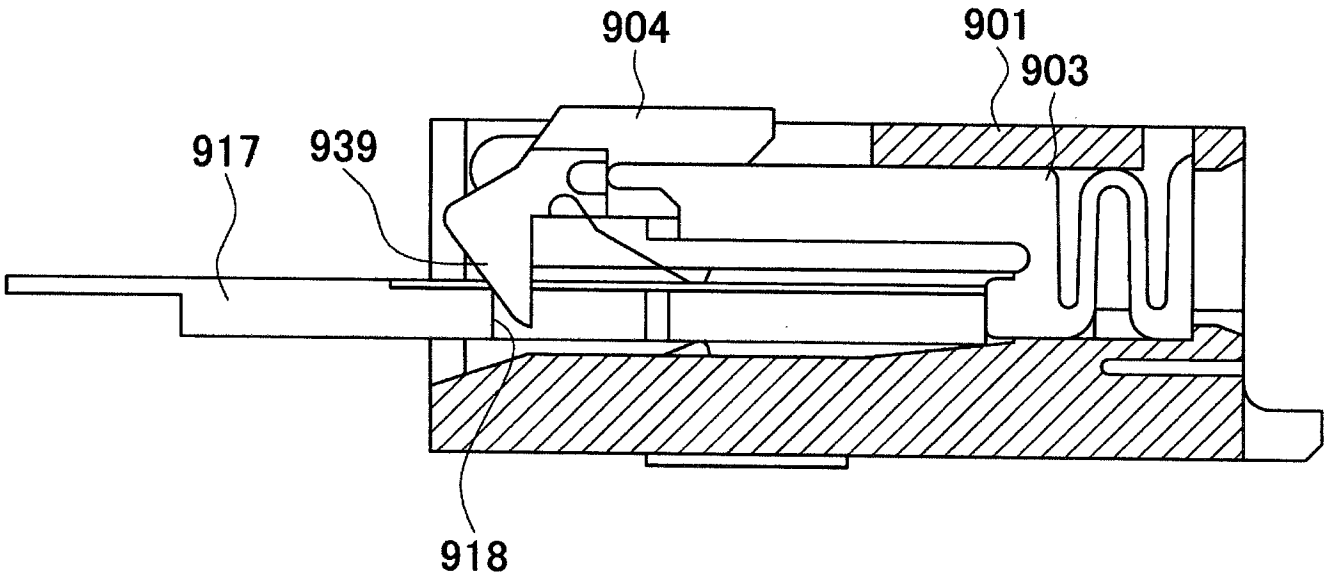
FIG. 17 is a cross-sectional view of the connector appearing in FIG. 15 in a state having the board pushed therein, causing an abutment receiving portion to enter a latching cutout.

The connector 10 has no components corresponding to the engaging members 903 of the conventional connector, shown in FIGS. 15 to 17, and hence the connector 10 is simple in construction with a less number of components.

Further, in the conventional connector, the engaging members 903 offers resistance when the board 917 is inserted into the housing 901. However, the connector 10 of the present embodiment has no components corresponding to the engaging members 903, and hence it is possible to insert the flexible printed wiring board 80 into the insertion portion 31 of the housing 30 with a smaller force than in the case of the conventional connector.

In the present embodiment, the connector 10 has no components corresponding to a partition plate 907 of the conventional connector, and hence it is possible to press-fit the first contacts 50 from the front of the housing 30, and the second contacts 60 from the rear of the housing 30, and arrange the connection portion 55 of each first contact 50 at the front of the housing 30, and the connection portion 65 of each second contact 60 at the rear of the housing 30. As a result, it is possible to reduce the arrangement pitch of the first contacts 50 and the second contacts 60, and thereby reduce the size of the connector 10 in the longitudinal direction LH.

Figure 13:
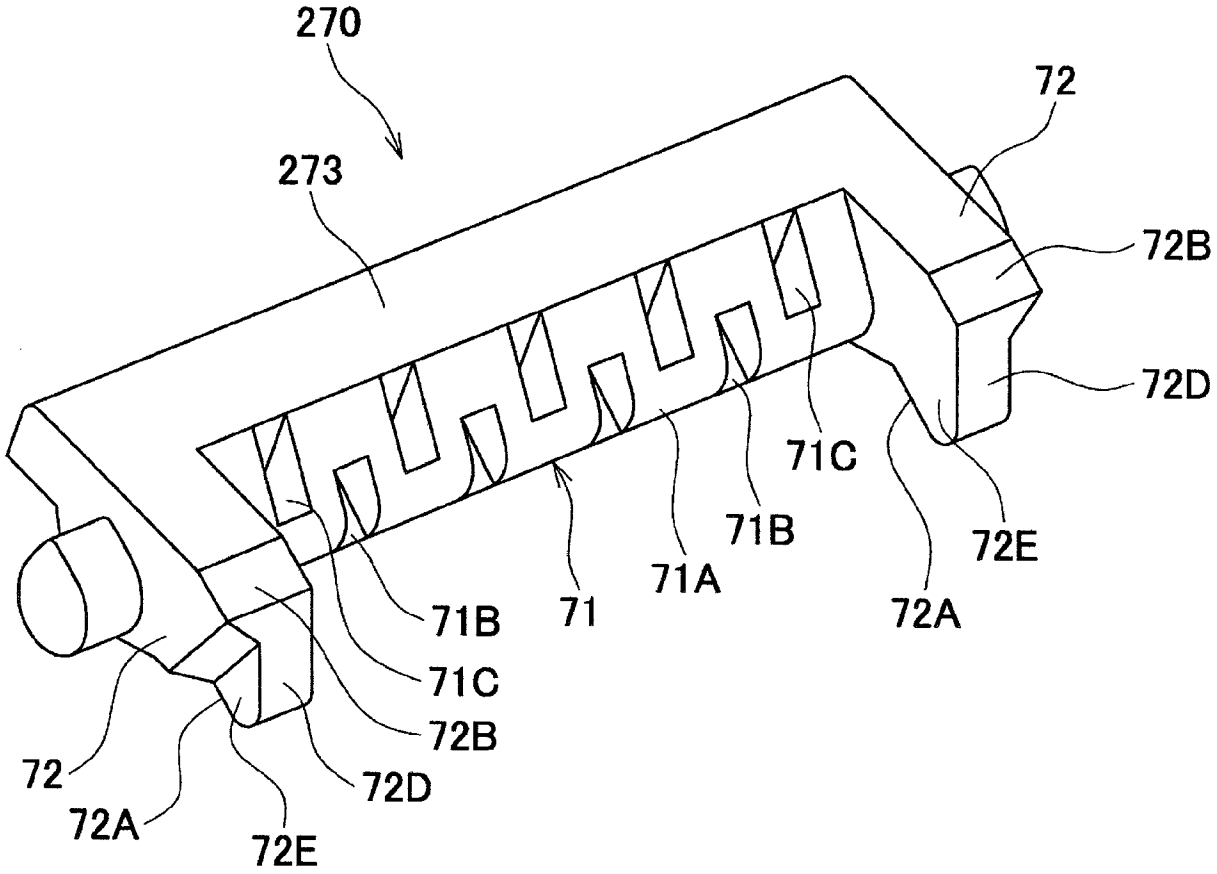
FIG. 13 is a perspective view of an operation member of a connector according to a second embodiment of the present invention.

Next, a description will be given of a connector according to a second embodiment of the present invention with reference to FIGS. 13 to 14C.

The same components as those of the connector according to the first embodiment are denoted by the same reference numerals, and detailed description thereof is omitted. The following description will be given of only different points from those of the first embodiment.

An operation member 270 of the connector, denoted by reference numeral 210, includes an unlocking operation portion 273 which applies a rotational force to the abutment portions 72 to thereby cause the locking portions 72E received in receiving portions (housing-side receiving portions) 235 to move out of the insertion portion 31. Further, although the receiving portions 35 of the housing 30 of the first embodiment are recesses, the receiving portions 235 of a housing 230 of the second embodiment are through holes. The connector 210 of the second embodiment differs from the connector 10 of the first embodiment in these two points. The connector 210 of the second embodiment is the same as the connector 10 of the first embodiment in the other points. The unlocking operation portion 273 is integrally formed with the operation portion 71 and the abutment portions 72, and extends in parallel to the body 71A of the operation portion 71.

Next, a description will be given of the operation of the connector 210.

Figure 14A:
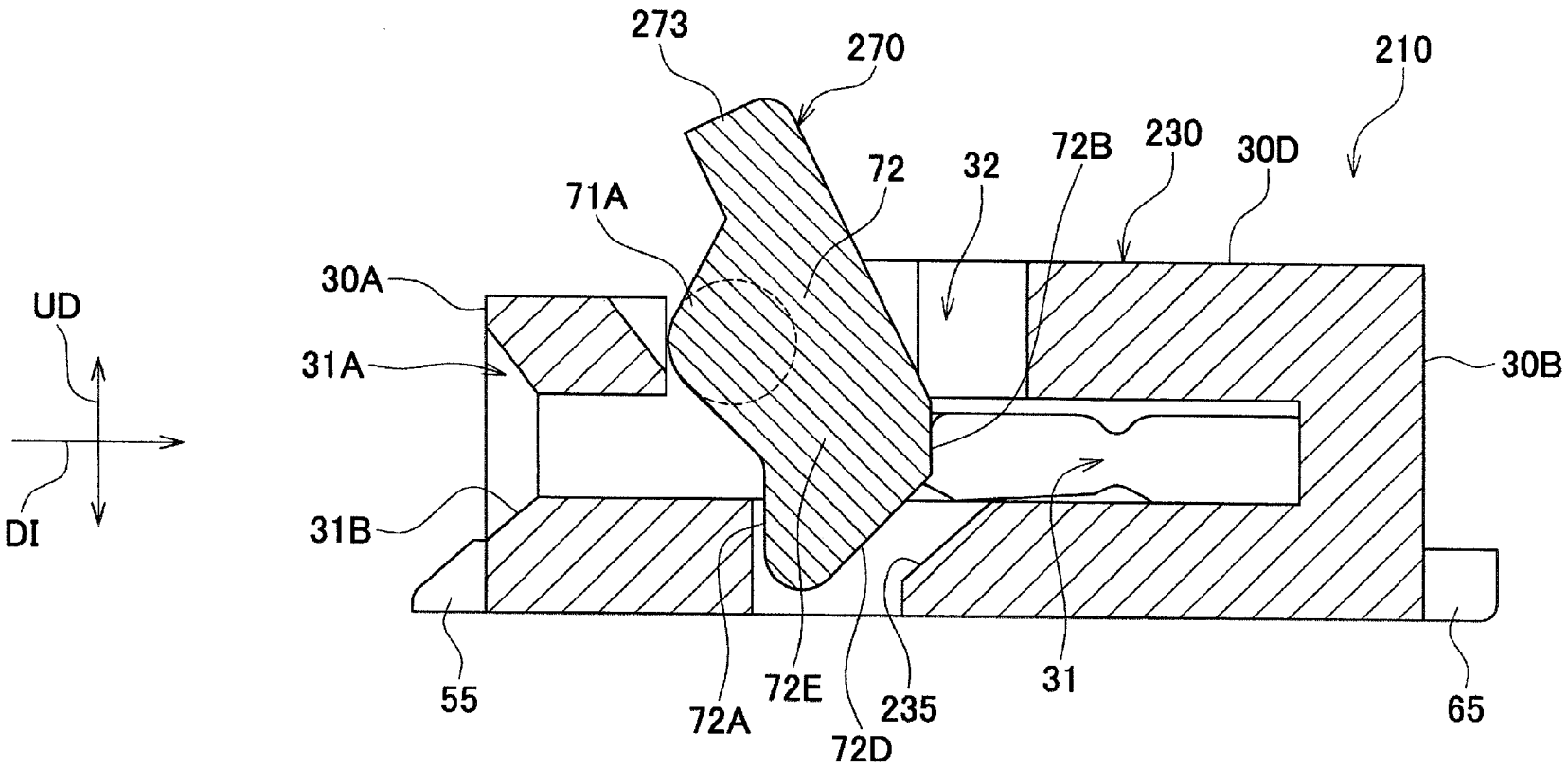
FIG. 14A is a cross-sectional view of the connector according to the second embodiment before having a flexible printed wiring board connected thereto, sectioned through an abutment portion.

Before the flexible printed wiring board 80 is inserted into the insertion portion 31 of the housing 230, the unlocking operation portion 273 of the operation member 270 is in an erected position (see FIG. 14A).

Figure 14B:
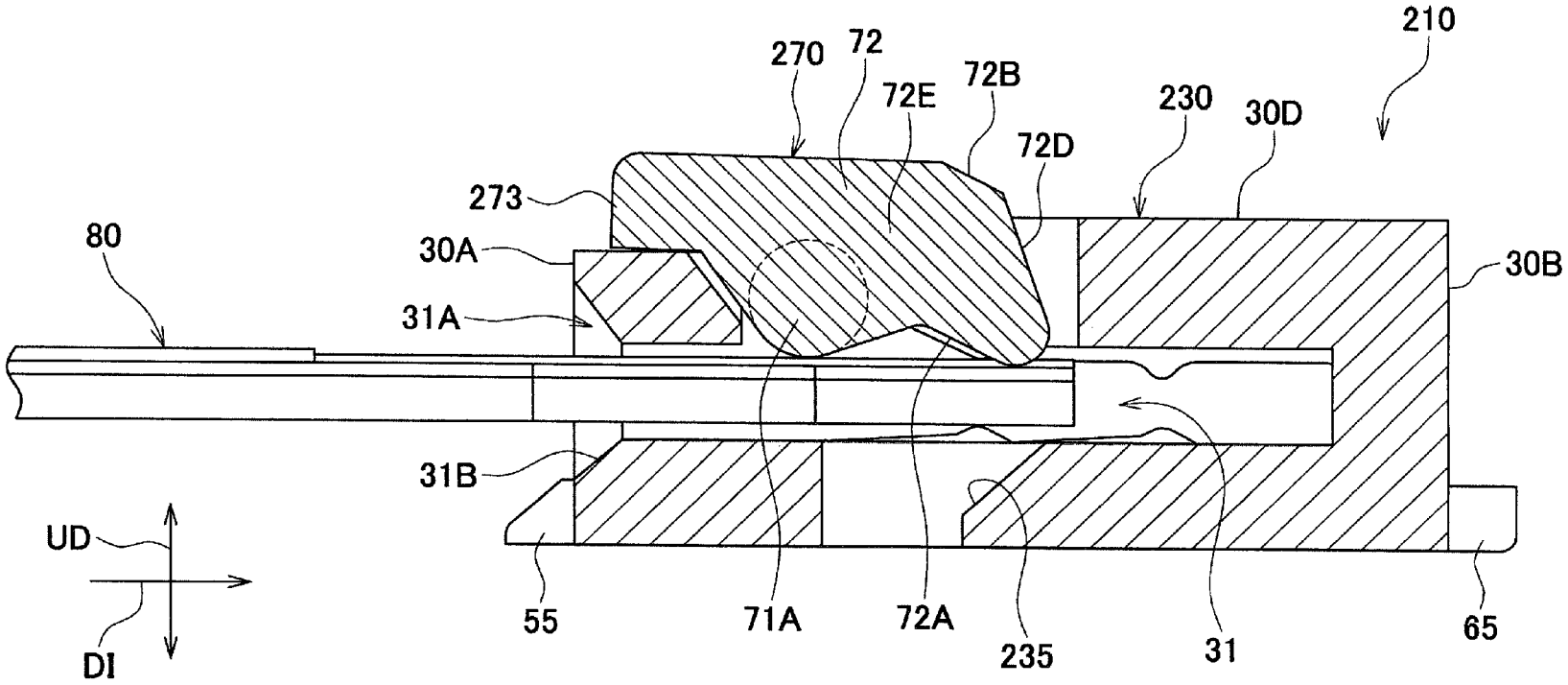
FIG. 14B is a cross-sectional view of the connector according to the second embodiment in a state having the flexible printed wiring board halfway connected thereto, sectioned through the abutment portion.

When the flexible printed wiring board 80 is inserted into the insertion portion 31 of the housing 230, the abutment portions 72 of the operation member 270 are pushed and rotated by the flexible printed wiring board 80, and the abutment portions 72 are moved out of the insertion portion 31 of the housing 230 (see FIG. 14B).

Figure 14C:
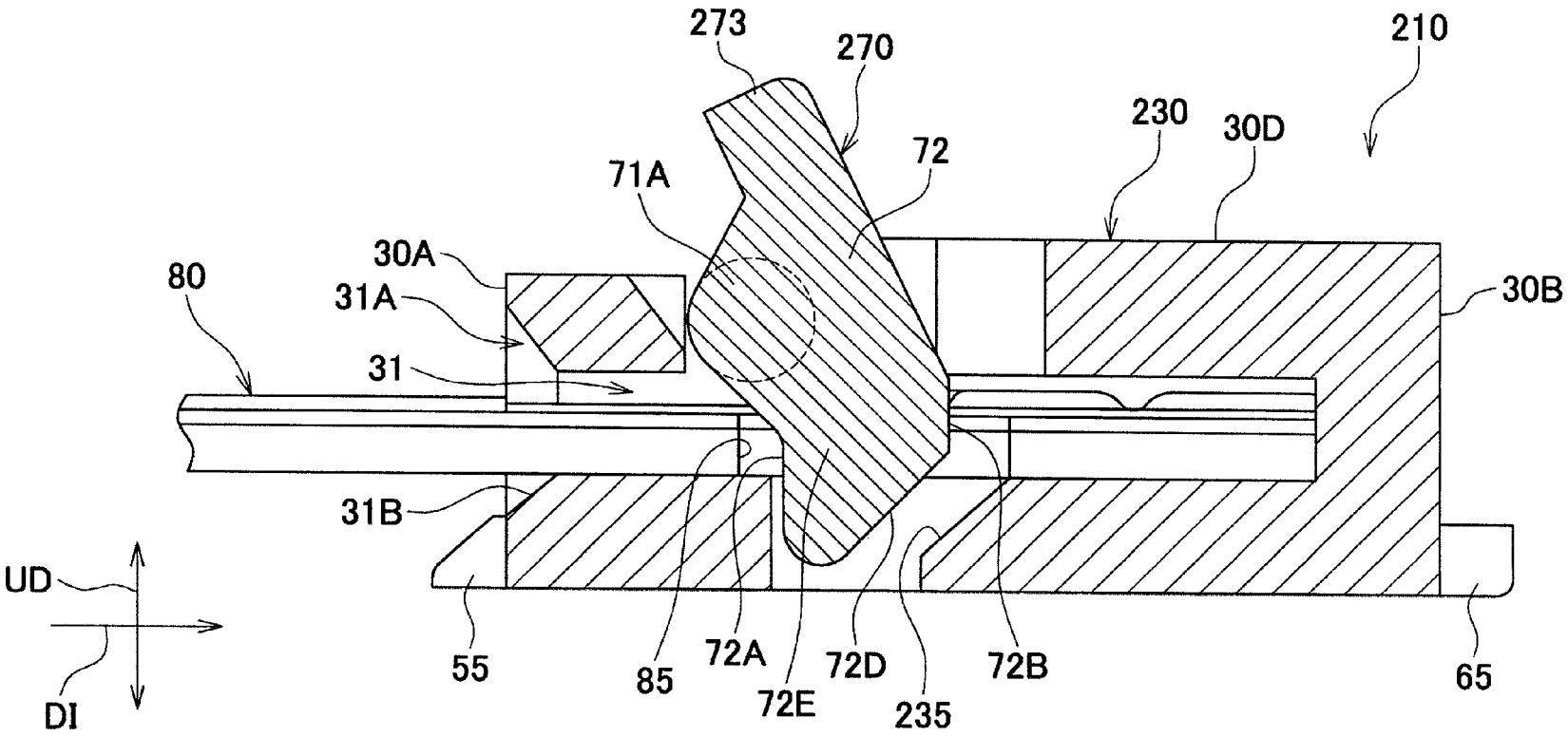
FIG. 14C is a cross-sectional view of the connector according to the second embodiment in a state having the flexible printed wiring board connected thereto, sectioned through the abutment portion.

When the flexible printed wiring board 80 is inserted to a predetermined position in the insertion portion 31 of the housing 230, the locking portions 72E of the abutment portions 72 of the operation member 270 enter the receiving portions 235 of the housing 230 through the receiving portions 85 of the flexible printed wiring board 80, respectively (see FIG. 14C). As a result, the flexible printed wiring board 80 is locked by the locking portions 72E of the abutment portions 72.

To pull the flexible printed wiring board 80 out of the housing 230 in a state in which the flexible printed wiring board 80 has been locked by the locking portions 72E, the unlocking operation portion 273 is pushed down with a finger from the state of the operation member 270 shown in FIG. 14C, to cause the same to fall forward (see the state of the operation member 270 shown in FIG. 14B). As a result, the locking portions 72E of the abutment portions 72 are moved out of the receiving portions 235 of the housing 230, respectively, whereby the flexible printed wiring board 80 is released from the state locked by the locking portions 72E, and can be pulled out of the housing 230.

According to the second embodiment, it is possible to obtain the same advantageous effects as provided by the first embodiment, and it is possible to easily pull the flexible printed wiring board 80 out of the housing 230 since the flexible printed wiring board 80 can be released from state locked by the locking portions 72E by operating the unlocking operation portion 273 of the operation member 270 with a finger.

Although in the above-described embodiments, two types of the contacts (the first contact 50 and the second contact 60) are employed, one type of the contact may be employed, or three or more types of contacts may be employed according to the use of the connector 10.

Further, although the first contact 50 and the second contact 60 include the first contact portions 52 and 62 and the second contact portions 57 and 67, respectively, the first contact 50 and the second contact 60 are each only required to include at least one contact portion.

Although in the above-described embodiments, the first contact 50 and the second contact 60 include the spring portions 56 and 66, respectively, the spring portions 56 and 66 are not necessarily required.

Further, although in the above-described embodiments, the first contact 50 and the second contact 60 include the fixed arm portions 53 and 63, respectively, the fixed arm portions 53 and 63 are not necessarily required.

Further, although in the above-described embodiments, the connection portions 55 of the first contacts 50 are arranged at the front end of the housing 30, and the connection portions 65 of the second contacts 60 are arranged at the rear end of the housing 30, the arrangement may be such that connection portions (not shown) of the first contacts and connection portions (not shown) of the second contacts are alternately arranged in a row at the front end of the housing 30, or are alternately arranged in a row at the rear end of the housing 30.

Further, although in the above-described embodiments, the recess and the through hole are employed as an example of the housing-side receiving portion (receiving portions 35 and 235), a cutout may be employed in place of the recess or the through hole. Further, although the cutout is employed as an example of the object-to-be-connected side receiving portion (receiving portion 85), a through hole may be employed in place of the cutout.

Although in the above-described embodiments, the flexible printed wiring board 80 has been taken as an example of the object to be connected, the object to be connected is not limited to the flexible printed wiring board 80, but may be a printed circuit board (not shown) insofar as it is provided with an object-to-be-connected-side receiving portion. On the other hand, although the printed circuit board, not shown, has been taken as an example of the other object to be connected, the other object to be connected is not limited to the printed circuit board, but may be a flexible printed wiring board (not shown).

It is further understood by those skilled in the art that the foregoing are the preferred embodiments of the present invention, and that various changes and modification may be made thereto without departing from the spirit and scope thereof.

What is claimed is:

1. A connector comprising:

a housing having an insertion portion in which an object to be connected is insertable;

a plurality of contacts that are held by said housing, and each include a movable arm portion which extends from an inner end of the insertion portion toward an insertion slot of the insertion portion and is elastically deformable; and an operation member that is rotatably supported by said housing, and includes an operation portion which operates said movable arm portion, and an abutment portion which is linked to said operation portion and is pushed and rotated by the object to be connected which is inserted into the insertion portion to thereby transmit a rotational force to said operation portion, wherein when the object to be connected is inserted into the insertion portion, said abutment portion is pushed by the object to be connected to thereby rotate in a direction away from the insertion portion, and said operation portion is rotated to thereby move said movable arm portion in a direction away from the insertion portion, and when the object to be connected is inserted to a predetermined position in the insertion portion, said movable arm portion is moved in a direction approaching to the insertion portion, wherein said abutment portion includes a locking portion which is inserted in an object-to-be-connected-side receiving portion formed in the object to be connected when the object to be connected is inserted to the predetermined position in the insertion portion, to thereby prevent the object to be connected from moving in a direction opposite to a direction of inserting the object to be connected, wherein said housing includes a housing-side receiving portion which receives said locking portion when the object to be connected is inserted to the predetermined position in the insertion portion, to thereby prevent said abutment portion from moving in the opposite direction, wherein said plurality of contacts each include a contact portion which is provided on said movable arm portion, protrudes into the insertion portion, and is brought into contact with the object to be connected, wherein said plurality of contacts are formed by first contacts and second contacts which are different in type from said first contacts, wherein said first contacts and said second contacts are alternately arranged at predetermined intervals in a longitudinal direction of said housing, wherein said operation portion includes a body having a cylindrical shape, first recesses which are provided in said body and receive front ends of said first contacts, respectively, and second recesses which are provided in said body and receive front ends of said second contacts, respectively, wherein said first recesses and said second recesses are arranged alternately at predetermined intervals in a longitudinal direction of said body, and wherein the positions of each first recess and each second recess are displaced by 90 degrees in a circumferential direction of said body.

2. The connector according to claim 1, wherein said abutment portion is at a location closer to the inner end of the insertion portion than said operation portion is.

3. The connector according to claim 1, wherein said operation member includes an unlocking operation portion which applies a rotational force to said abutment portion to thereby cause said locking portion received in said housing-side receiving portion to be moved out of the insertion portion.

4. The connector according to claim 2, wherein said operation member includes an unlocking operation portion which applies a rotational force to said abutment portion to thereby cause said locking portion received in said housing-side receiving portion to be moved out of the insertion portion.

5. The connector according to claim 1, wherein said plurality of contacts each include a fixed arm portion which extends from the inner end of the insertion portion toward the insertion slot, a linking portion which links said fixed arm portion and said movable arm portion at the inner end of the insertion portion, and a connection portion which is formed on said fixed arm portion and is connected to another object to be connected.

6. The connector according to claim 2, wherein said plurality of contacts each include a fixed arm portion which extends from the inner end of the insertion portion toward the insertion slot, a linking portion which links said fixed arm portion and said movable arm portion at the inner end of the insertion portion, and a connection portion which is formed on said fixed arm portion and is connected to another object to be connected.

7. The connector according to claim 5, wherein said plurality of contacts each include a spring portion which is provided on said fixed arm portion and extends from toward the insertion slot toward the inner end of the insertion portion, and a fixed arm portion side contact portion which is provided on said spring portion in a manner opposed to said contact portion and protrudes into the insertion portion, and wherein at least one of said contact portion and said fixed arm portion-side contact portion is brought into contact with the object to be connected.

8. The connector according to claim 6, wherein said plurality of contacts each include a spring portion which is provided on said fixed arm portion and extends from toward the insertion slot toward the inner end of the insertion portion, and a fixed arm portion side contact portion which is provided on said spring portion in a manner opposed to said contact portion and protrudes into the insertion portion, and wherein at least one of said contact portion and said fixed arm portion-side contact portion is brought into contact with the object to be connected.

9. The connector according to claim 1, wherein the positions of said contact portion of each first contact and said contact portion of each second contact are displaced in the direction of inserting the object to be connected, wherein said first contacts are mounted from a side of the insertion slot of said housing, and wherein said second contacts are mounted from a rear side of said housing.

10. The connector according to claim 2, wherein the positions of said contact portion of each first contact and said contact portion of each second contact are displaced in the direction of inserting the object to be connected, wherein said first contacts are mounted from a side of the insertion slot of said housing, and wherein said second contacts are mounted from a rear side of said housing.

11. The connector according to claim 1, wherein said connection portion of said first contact is at a location toward the insertion slot, and said connection portion of said second contact is at a location toward the rear surface of said housing.

12. The connector according to claim 2, wherein said connection portion of said first contact is at a location toward the insertion slot, and said connection portion of said second contact is at a location toward the rear surface of said housing.

13. The connector according to claim 1, wherein the insertion slot of said housing has a periphery provided with a guiding portion for guiding the object to be connected into the insertion portion.

14. The connector according to claim 2, wherein the insertion slot of said housing has a periphery provided with a guiding portion for guiding the object to be connected into the insertion portion.

* * * * *